US006758025B2

(12) United States Patent
Haberler

(10) Patent No.: US 6,758,025 B2
(45) Date of Patent: Jul. 6, 2004

(54) METHOD OF FORMING A SWIMMING POOL CONSTRUCTION

(76) Inventor: Gerhard Haberler, 1346 Chevrier Blvd., Winnipeg (CA), R2H 2P6

( * ) Notice: Subject to any disclaimer, the term of this patent is extended or adjusted under 35 U.S.C. 154(b) by 0 days.

(21) Appl. No.: 09/955,486

(22) Filed: Sep. 19, 2001

(65) Prior Publication Data

US 2003/0051432 A1 Mar. 20, 2003

(51) Int. Cl.[7] ..... E04B 1/00; E02D 27/00

(52) U.S. Cl. ..... 52/741.11; 52/127.2; 52/169.8; 52/169.9; 52/247; 52/294

(58) Field of Search ..... 52/169.7, 169.8, 52/250, 741.11, 741.12, 741.14, 245, 247, 259, 261, 262, 266, 294, 299, 102, 169.9, 293.1, 127.2, 127.4; 4/506, 513; 249/19, 22, 11, 18, 34, 209

(56) References Cited

U.S. PATENT DOCUMENTS

| | | | | | |
|---|---|---|---|---|---|
| 2,741,910 | A | | 4/1956 | Thornely | |
| 3,391,790 | A | | 7/1968 | Lerner | |
| 3,693,927 | A | * | 9/1972 | Jennings | 249/11 |
| 3,820,174 | A | | 6/1974 | Rozanski | |
| 4,007,566 | A | | 2/1977 | Molitor | |
| 4,015,379 | A | * | 4/1977 | Colson, Jr. | 52/169.8 |
| 4,050,104 | A | | 9/1977 | Baker | |
| 4,077,173 | A | * | 3/1978 | Rozanski | 52/169.8 |
| 4,090,266 | A | | 5/1978 | Price | |
| 4,109,324 | A | | 8/1978 | Cornelius | |
| 4,120,126 | A | | 10/1978 | West | |
| 4,124,907 | A | * | 11/1978 | Laven | 52/169.7 |
| 4,185,805 | A | * | 1/1980 | Ewing | 249/210 |
| 4,407,102 | A | | 10/1983 | Boyack | |
| 4,566,141 | A | * | 1/1986 | Mahoney | 4/506 |
| 4,679,763 | A | * | 7/1987 | Brotherton | 29/446 |
| 4,874,150 | A | * | 10/1989 | Heinzle | 249/18 |
| 5,137,251 | A | * | 8/1992 | Jennings | 249/189 |
| 5,163,967 | A | * | 11/1992 | Hoffman et al. | 52/299 |
| 5,325,644 | A | * | 7/1994 | Cornelius | 52/169.7 |
| 5,330,151 | A | * | 7/1994 | Boyack | 249/83 |
| 5,425,145 | A | | 6/1995 | Baker | |
| 5,590,493 | A | * | 1/1997 | Wilson | 52/108 |
| 6,094,877 | A | * | 8/2000 | White | 52/247 |
| 6,332,599 | B1 | * | 12/2001 | Spartz | 249/34 |

FOREIGN PATENT DOCUMENTS

| | | | | |
|---|---|---|---|---|
| CA | 2125748 | | 12/1994 | |
| FR | 1529616 | * | 5/1968 | |
| FR | 2650020 A1 | * | 1/1991 | E04H/4/02 |

* cited by examiner

*Primary Examiner*—Lanna Mai
*Assistant Examiner*—John Fitzgerald
(74) *Attorney, Agent, or Firm*—Adrian D. Battison; Michael R. Williams; Ryan W. Dupuis

(57) ABSTRACT

A swimming pool construction is of the type using metal fabricated walls and a plastics liner covering the walls and a rigid excavated pool base. The metal fabricated walls include spaced inner and outer panels defining therebetween a crawl space. The inner panels define the inner surface of the pool. The outer panels engage the surrounding soil. The panels are mounted on support members and rails supported on pairs of piles at spaced positions around the periphery of the pool. The panels are supported initially on bottom rails which are used as forms to cast a concrete layer therebetween. The panels are supported in spaced positions temporarily by a rigid arch form into which is cast a cast concrete arch allowing the rails and the arch form to be removed for re-use. The arch is cast integrally with a concrete floor which sits on supporting panels bridging the rails and resting on flat top supporting surfaces of the concrete piles. A top concrete cover is cast onto bridging panels spanning between the inner and outer walls and carried on the top of the arches.

20 Claims, 17 Drawing Sheets

METHOD OF FORMING A SWIMMING POOL CONSTRUCTION

This invention relates to a method of forming a swimming pool construction.

BACKGROUND OF THE INVENTION

Various different designs and construction techniques have been used for manufacture of excavated or in ground pool constructions. One technique uses cast concrete reinforced by reinforcing steel for constructing the base and walls of the pool. The inside surface of the concrete is then suitably coated or lined with tiles. This form of construction has been widely used in commercial pools which tend to be significantly larger and require much stronger construction to accommodate relatively large amounts of people and water involved in such larger pools. However the concrete construction is relatively expensive and in some soil conditions has significant problems of cracking due to soil movement. Relatively large costs can therefore be expected in renovation work after the initial cost of installation.

A common technique for constructing pools for backyard or home use involves the installation of walls formed from metal panels which are then reinforced by inclined braces. After installation, the space between the excavated soil and the outside surface of the metal panel is then filled with suitable filling material so that the forces from the water on one side of the metal panel are to some extent balanced by inward forces from the soil and filling material on the outside of the metal panel. A covering layer is then applied to the excavated pool base and a liner of a suitable plastics material is applied over the covering layer and over the metal walls to contain the water.

Pools of this type are generally satisfactory for lightweight home use in which the dimensions of the pool are relatively small but it is generally accepted that pools of this construction are not acceptable for large scale commercial size pools due to the instability of the structure. In addition pools of this type generally cannot be emptied due to the necessity to maintain a balance between the outward pressure of the water and the inward pressure from the soil. If the water is removed therefore there is a significant danger of collapse.

However it is also well known that the metal fabricated structure is significantly cheaper than the concrete formation and does not suffer from the very heavy costs of renovation or repair which can become necessary with the concrete structure.

Canadian Patent application 2,125,748 of the present inventor filed Jun. 13, 1994 and published December 1994 discloses a construction for a swimming pool which has inner and outer metal wall panels defining a space between. This construction has achieved some commercial success but is relatively difficult to assemble and to manufacture requiring considerable labour costs.

French patent application 1529616 shows a similar double wall construction fabricated from wood and metal elements but this is not suitable for rapid assembly.

U.S. Pat. No. 4,120,126 (West) issued Oct. 17, 1978 discloses a pool wall constructed from metal and wood components having an inner wall and an outer supporting element which is filled with soil between the two elements.

U.S. Pat. No. 4,090,266 (Price) issued May 23, 1978 discloses a pool wall construction in which the wall is supported by concrete posts cast around junctions between the wall panels and connected to a horizontal cast base.

U.S. Pat. Nos. 3,820,174 (Rozanski) issued Jun. 28, 1974, 4,007,566 (Molitor) issued Feb. 15, 1977, 4,050,104 (Baker) issued Sep. 27, 1977, 3,391,790 (Lerner) issued Jul. 9, 1968, 4,109,324 (Cornelius) issued Aug. 29, 1978, 4,407,102 (Boyack) issued Oct. 4, 1983 and 5,425,145 (Baker) issued Jun. 20, 1995 all show various swimming pool constructions.

U.S. Pat. No. 2,741,910 (Thornely) issued Apr. 17, 1956 discloses a building foundation using piles.

None of the above constructions however provide a modular assembly which can be rapidly and easily assembled and can be completed by pouring concrete to form the necessary structural elements.

SUMMARY OF THE INVENTION

It is one object of the present invention, therefore, to provide an improved swimming pool construction which enables the advantages of the metal fabricated structure to be used in the large scale commercial size swimming pool while providing forming structures which can be readily removed and reused after the concrete structure has been cast for metal walls.

According to a first aspect of the invention, therefore, there is provided a method of forming a swimming pool construction having a peripheral pool wall of a predetermined pool shape comprising:

providing a plurality of ground anchor members arranged at longitudinally spaced positions around the predetermined pool shape and at a common levelled height;

the ground anchor members including an inner row and an outer row spaced at a common distance outwardly relative to the pool shape from the inner row;

providing on each of the inner row of the ground anchor members an inwardly extending inner support member;

providing on each of the outer row of the ground anchor members an outwardly extending outer support member;

providing a plurality of inner rail members and a plurality of outer rail members each having a bottom support surface and a vertical abutment surface;

arranging the inner rail members end to end and mounting the inner rail members with the horizontal flange thereof supported on the inner support members to follow the pool shape, the vertical abutment surface of the inner rail members oriented to define an outwardly facing retaining surface;

arranging the outer rail members end to end and mounting the outer rail members with the horizontal flange thereof supported on the outer support members to follow the pool shape, the vertical abutment surface of the outer rail members oriented to define an inwardly facing retaining surface;

providing a plurality of inner pool wall panels;

locating a bottom edge of the inner pool wall panels on the inner rail members at the outwardly facing retaining surface of the inner rail members so as to stand upwardly therefrom and connecting the inner wall panels end to end to form an inner pool wall;

supporting the inner pool wall panels so as to stand vertically upwardly from the inner rail members;

casting a concrete base layer between the outwardly facing retaining surface of the inner rail members and the inwardly facing retaining surface of the outer rail members such that the concrete base layer engages the bottom edge of the wall panels;

and removing the inner and outer rail members leaving the wall panels supported in place on the concrete base layer.

Preferably each of the inner and outer rail members comprises an angle member defining a vertical flange forming the vertical abutment surface and a horizontal flange forming the bottom support surface and wherein the flange is located underneath the bottom edge of the inner pool wall panels so as to provide support therefor.

Preferably the bottom edge of the inner wall panels includes an outwardly turned edge flange member.

Preferably a horizontal flange of the rail member rests upon the inner support member and is temporarily attached thereto.

Preferably a substantially horizontal floor panel extends across and rests upon the horizontal flange members for supporting the concrete layer when cast.

Preferably the inner pool wall panels have a bottom flange resting upon an edge of the horizontal floor panel at the vertical abutment surface.

Preferably the ground anchor members are formed of cast concrete having a flat supporting top surface; wherein the inner and outer support member have an upper support surface of the support member flush with the respective flat top surface; wherein there is provided a plurality of floor panels which are located so as to span between the vertical abutment surfaces of the inner and outer rail members and so as to rest upon the inner and outer rail members and closely adjacent the flat top surfaces of the cast concrete ground anchor members; wherein holes are cut in the floor panels at the flat top surfaces of the ground anchor members and wherein the concrete base layer is cast on the floor panels between the outwardly facing retaining surface of the inner rail members and the inwardly facing retaining surface of the outer rail members and through the holes such that the concrete base layer rests upon and receives support from the flat top of the cast concrete ground anchor members.

Preferably the inner and outer support members are each defined by a U-shaped channel member with legs thereof facing upwardly so that the horizontal flanges rest thereon.

Preferably the method includes:

providing a plurality of outer pool wall panels;

locating a bottom edge of the outer pool wall panels on the outer rail members at the inwardly facing retaining surface of the outer rail members so as to stand upwardly therefrom and connecting the outer wall panels end to end to form an outer pool wall;

supporting the outer pool wall panels so as to stand vertically upwardly from the outer rail members;

the inner and outer wall panels being supported by:

forming a plurality of arch members each having a first leg at a respective one of the inner wall panels, a second leg at a respective one of the outer wall panels and a cross piece;

the legs of the arch member comprising a channel shaped structure having a pair of side walls spaced along the panel and a web wall spanning the side walls and spaced from the respective panel;

the cross piece of the arch member comprising a channel shaped structure having a pair of side walls spaced along the inner and outer panels and a web wall spanning the side walls and spaced downwardly from a top edge of the side walls;

casting a concrete arch into the arch member such that one leg of the arch is connected to the inner panel and the other leg of the arch is connected to the outer panel;

and removing the arch members such that the inner and outer wall panels are supported by the cast concrete arches.

Preferably the method includes forming the arch member in two parts each defined by one side wall of the cross piece and one side wall of each of the legs and one portion of the web of the cross piece and each of the legs such that the two parts are connected together along a seam across the webs of the legs and the crosspiece, the arch member so formed being rigid so that the legs are retained at right angles to the cross piece to hold the inner and outer panels parallel and at a required spacing;

Preferably the method includes casting the arches and the base layer substantially simultaneously such that setting occurs simultaneously to form an integral structure.

Preferably the method includes providing the arch members at the bottom of the legs thereof with an open mouth and forming the base layer to a level substantially equal to the bottom of the legs so as to be integral with the cast arch and allowing the arch member to be removed from the arch and from the base layer.

Preferably the method includes forming for each leg of each arch member on the respective one of the inner and outer wall panels a pair of parallel vertical flanges and bolting the sides of the leg to the flanges for casting of the arch and for subsequent removal of the arch member.

Preferably the method includes providing a plurality of top supporting panels and supporting each support panel on the arches across the inner and outer wall panels and between the arches and casting a concrete cover layer over the support panels.

Preferably the method includes supplying the rail members in a pre-curved shape to match said predetermined pool shape and supplying the panels in a flat shape for curving to match the rail members.

According to a second aspect of the invention, therefore, there is provided a method of forming a swimming pool construction having a peripheral pool wall of a predetermined pool shape comprising:

providing a plurality of cast concrete ground anchor members arranged at longitudinally spaced positions around the predetermined pool shape and at a common levelled height;

the cast concrete ground anchor members including an inner row and an outer row spaced at a common distance outwardly relative to the pool shape from the inner row;

the cast concrete ground anchor members having a supporting top surface;

providing on each of the inner row of the ground anchor members an inwardly extending inner support member having an upper support surface of the support member flush with the top surface;

providing on each of the outer row of the ground anchor members an outwardly extending outer support member having an upper support surface of the support member flush with the top surface;

providing a plurality of inner rail members and a plurality of outer rail members;

arranging the inner rail members end to end and mounting the inner rail members supported on the inner support members to follow the pool shape;

arranging the outer rail members end to end and mounting the outer rail members supported on the outer support members to follow the pool shape;

providing a plurality of floor panels and locating the floor panels so as to span between the inner and outer rail members and so as to rest upon the inner and outer rail members;

providing a plurality of inner pool wall panels;

locating a bottom edge flange of the inner pool wall panels on an outer edge of the floor panels at the inner rail members so as to stand upwardly therefrom and connecting the inner wall panels end to end to form an inner pool wall;

supporting the inner pool wall panels so as to stand vertically upwardly from the inner rail members;

cutting holes in the floor panels at the ground anchor members;

casting a concrete base layer on the floor panels between the inner rail members and the outer rail members and through the holes such that the concrete base layer rests upon and receives support from the flat top of the cast concrete ground anchor members;

and removing the inner and outer rail members leaving the wall panels supported in place on the concrete base layer.

Preferably the inner and outer support members are each defined by a U-shaped channel member with legs thereof facing upwardly so that the horizontal flanges rest thereon.

According to a third aspect of the invention, therefore, there is provided a method of forming a swimming pool construction having a peripheral pool wall of a predetermined pool shape comprising:

providing a plurality of inner pool wall panels;

locating and supporting the inner pool wall panels so as to stand generally vertically upwardly and to follow the predetermined pool shape;

and supporting the inner wall panels by:

forming a plurality of arch members at spaced positions around the pool each having a first leg at a respective one of the inner wall panels, a second leg spaced outwardly from the inner wall panels and a cross piece;

the legs of the arch member comprising a channel shaped structure having a pair of side walls spaced along the respective panel and a web wall spanning the side walls and spaced from the respective panel;

the cross piece of the arch member comprising a channel shaped structure having a pair of side walls spaced along the inner and outer panels and a web wall spanning the side walls and spaced downwardly from a top edge of the side walls;

temporarily attaching edges of one of the legs to the inner panels;

casting a concrete arch into the arch member such that one leg of the arch is connected to the inner panel;

casting a concrete floor connected with the concrete arch;

and removing the arch members such that the inner wall panels are supported by the cast concrete arches and the concrete floor.

Preferably the method includes forming the arch member in two parts each defined by one side wall of the cross piece and one side wall of each of the legs and one portion of the web of the cross piece and each of the legs such that the two parts are connected together along a seam across the webs of the legs and the crosspiece; the arch member so formed being rigid so that the legs are retained at right angles to the crosspiece to hold the inner and outer panels parallel and at a required spacing.

According to a fourth aspect of the invention, therefore, there is provided a method of forming a swimming pool construction having a peripheral pool wall of a predetermined pool shape comprising:

providing a plurality of inner pool wall panels;

providing a plurality of outer pool wall panels;

locating and supporting the inner pool wall panels so as to stand generally vertically upwardly and to follow the predetermined pool shape;

locating and supporting the outer pool wall panels so as to stand generally vertically upwardly and to follow the inner wall panels at a position spaced outwardly therefrom;

and supporting the inner and outer wall panels by:

forming a plurality of arch members at spaced positions around the pool each having a first leg at a respective one of the inner wall panels, a second leg at a respective one of the outer wall panels and a cross piece;

the legs of the arch member comprising a channel shaped structure having a pair of side walls spaced along the respective panel and a web wall spanning the side walls and spaced from the respective panel;

the cross piece of the arch member comprising a channel shaped structure having a pair of side walls spaced along the inner and outer panels and a web wall spanning the side walls and spaced downwardly from a top edge of the side walls;

temporarily attaching edges of the legs to the inner and outer panels respectively;

casting a concrete arch into the arch member such that one leg of the arch is connected to the inner panel and the other leg of the arch is connected to the outer panel;

casting a concrete floor connected with the concrete arch;

and removing the arch members such that the inner and outer wall panels are supported by the cast concrete arches and the concrete floor.

Preferably the method includes forming the arch member in two parts each defined by one side wall of the cross piece and one side wall of each of the legs and one portion of the web of the cross piece and each of the legs such that the two parts are connected together along a seam across the webs of the legs and the crosspiece; the arch member so formed being rigid so that the legs are retained at right angles to the cross piece to hold the inner and outer panels parallel and at a required spacing.

According to a fifth aspect of the invention, therefore, there is provided a method of forming a swimming pool construction having a peripheral pool wall of a predetermined pool shape comprising:

providing a plurality of inner pool wall panels;

providing a plurality of outer pool wall panels;

locating and supporting the inner pool wall panels so as to stand generally vertically upwardly and to follow the predetermined pool shape;

locating and supporting the outer pool wall panels so as to stand generally vertically upwardly and to follow the inner wall panels at a position spaced outwardly therefrom;

and supporting the inner and outer wall panels by:

providing a plurality of rigid arch members at spaced positions around the pool shape each having a first leg at a respective one of the inner wall panels, a second leg at a respective one of the outer wall panels and a cross piece;

providing a rigid horizontal floor;

and providing a top cover member;

such that the rigid arch members support the walls and form with the top cover and the floor a crawl space surrounding the pool.

According to a sixth aspect of the invention, therefore, there is provided a method of forming a swimming pool construction having a peripheral pool wall of a predetermined pool shape comprising:

providing a plurality of inner pool wall panels;

supporting the inner pool wall panels so as to stand vertically upwardly and to follow the predetermined pool shape;

providing at a top edge and a bottom edge respectively of the inner wall panels an edge flange member turned at an angle to the inner wall panel so as to project outwardly therefrom to an outermost edge of the edge flange member;

providing in the edge flange member a plurality of slots therein extending from the outermost edge to the panel;

and bending of the panel about vertical lines in the panel with the slots allowing said bending.

Preferably the inner wall panels are attached to bottom supporting rail members and including supplying the rail members in a pre-curved shape to match said predetermined pool shape and supplying the panels in a flat shape for curving to match the rail members.

Preferably the method includes embedding the flange member at the bottom edge in the concrete base layer and embedding the flange member at the top edge in a concrete cover layer.

BRIEF DESCRIPTION OF THE DRAWINGS

One embodiment of the invention will now be described in conjunction with the accompanying drawings in which:

One embodiment of the invention will now be described in conjunction with the accompanying drawings in which:

FIG. 18 is a cross sectional view of the construction of FIGS. 13 to 17.

In the drawings like characters of reference indicate corresponding parts in the different figures.

DETAILED DESCRIPTION

Figure 1:
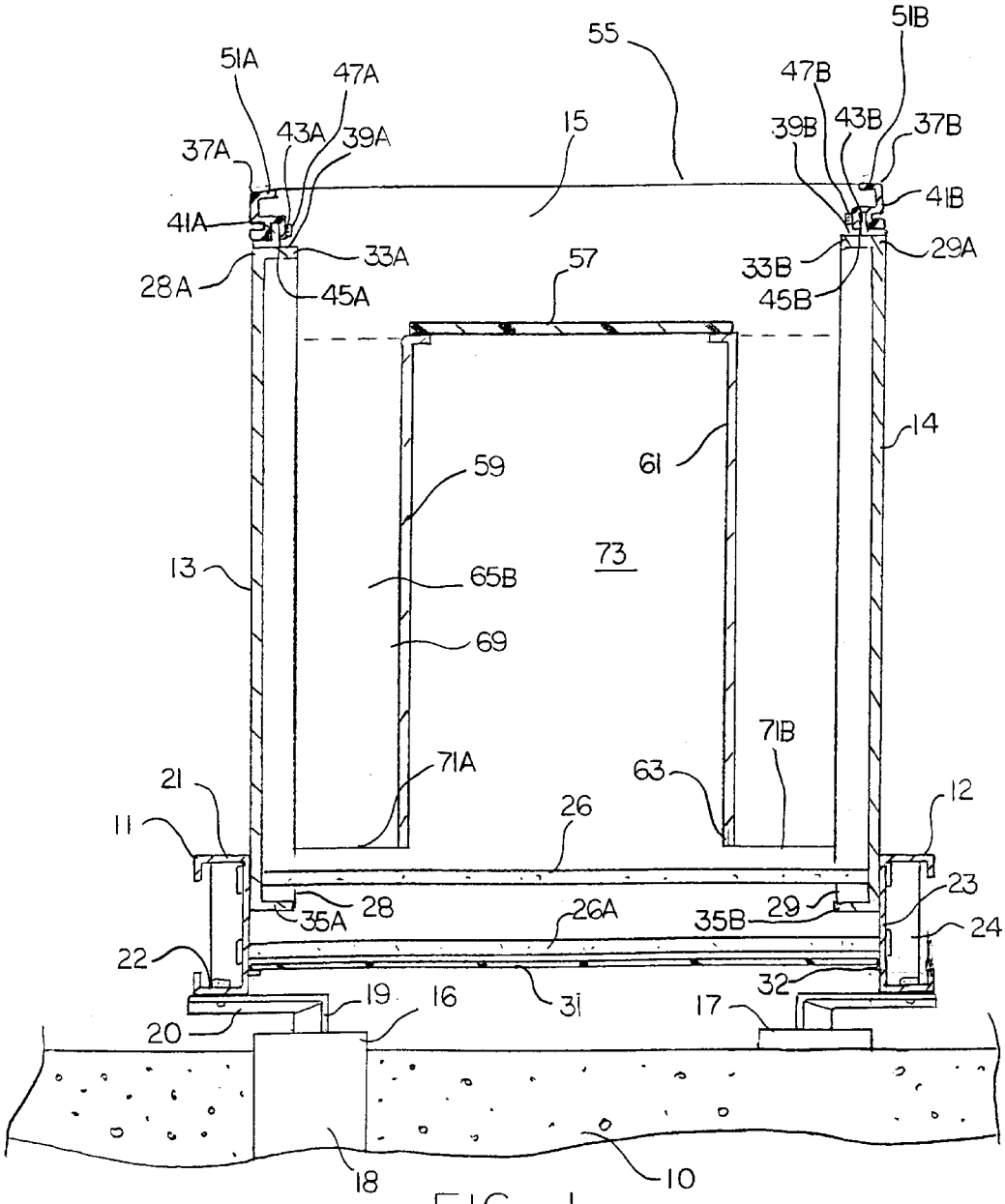
FIG. 1 is a vertical cross sectional view transversely of a swimming pool construction according to the present invention.

The pool construction in FIGS. 1 through 8 comprises a modular construction which can be used as a temporary installation using the construction elements as shown or can be used as a permanent installation in which the modular construction is used as a form for the addition of concrete structural members cast in place.

In FIGS. 1 through 10 is shown a double wall construction which is suitable for larger pool construction of the type normally used for public installations such as hotels, recreation complexes and the like. This construction provides a crawl space between the double wall construction through which the pipes can pass to supply the large quantity of water necessary for moving in a large area pool. The construction shown in FIG. 11 uses similar construction techniques to that shown in FIGS. 1 through 10 and as described hereinafter but can be used for smaller size pools where the quantity of water to be moved is insufficient to justify the extra expense of the double wall and crawl space construction.

The modular construction comprises a support base generally indicated at 10, a pair of side rails 11 and 12 carried on the support base, an inner wall structure 13, an outer wall structure 14 and a plurality of arch members 15. The wall structures 13 and 14 are carried on the side rails 11 and 12 and the wall structures are supported in vertical square orientation by the arch members 15.

In a temporary installation, the support base 10 can be provided simply a flat surface such as the concrete surface of an arena, a paved parking lot or the like.

In a permanent installation, the support base 10 is provided by an inner row 16 of anchor members and an outer row 17 of anchor members.

Each anchor member comprises as shown a concrete pile 18 which has cast into it a vertical post 19 with a horizontal support 20 attached to the top of the post. Preferably the post 19 is formed from an angle iron which is welded to a similar angle iron forming the support 20 which is held therefore at right angles to the post and provides a horizontal flange defining one side of the angle iron onto which the respective rails 11, 12 can be supported.

As an alternative to the angle iron post and support arrangement, the rebar in the pile can be bent at right angles to form a horizontal support. As a yet further alternative other forms of anchor can be used. In mounting the anchors in the ground or providing the other form of base support, careful levelling is applied so that the horizontal support surfaces on which the rails are mounted are at a common height.

In the embodiment as shown, the piles 16 and 17 are located at a spacing inwardly of the intended location of the rails with the horizontal support portion turned outwardly and extending outwardly from the piles. Thus the piles are located at a position substantially directly underneath the wall structures 13 and 14 so as to provide effective support of those wall structures and to communicate forces from those wall structures to the ground.

The rails 11 and 12 are generally C-shaped in cross section with a top horizontal flange 21, a bottom horizontal flange 22 and a substantially vertical back wall 23. The flanges 21 and 22 have downturned inward edges to provide a stiffening effect of the rails. The rails can be further stiffened by vertical webs 24 arranged at the ends of the rail portions and intermediate end. The rails are formed in separate rail portions each forming a part of the periphery of the pool shape. The rails are pre-formed in curved shapes suitable for manufacturing a predetermined pool shape.

The pool shape can be complex including compound curvatures or can be a simple shape which is substantially oval or rectangular depending upon requirements. Whatever the predetermined shape of the pool that is required, the individual rail portions are formed to the required shapes so when connected end to end form the complete peripheral shape that is required.

Of course the location of the piles or other anchor structure is arranged in the initial layout of the pool structure so that the piles also follow the intended pool shape with the inner rail and the inner row of anchors located at the inner wall of the pool and therefore actually constituting the shape of the pool and the outer anchors and the outer rail following the inner shape but spaced at a constant distance outwardly therefrom.

When the pool has reached its intended shape and the rails and piles have been placed in their respective positions the walls 13 and 14 are fixed to the appropriate rail. The walls are attached to the vertical back wall 23 and are supported in place with a first horizontal steel bar 26. The horizontal steel bar 26 is inserted through the bottom end 28 and 29 of the walls 13 and 14 and is then fixed to the vertical back wall 23 of the rails 11 and 12.

A second horizontal steel bar 26A is located below first horizontal steel bar 26. The second bar 26A is attached to the rails for increased support for the pool structure. The first bar 26 and the second bar 26A are positioned in a staggered manner wherein a first bar 26 is positioned ahead of the second bar 26A and so forth.

Located below the second bar 26A is a horizontal floor portion 31 which extends horizontally from either vertical back wall 23 of the rails and runs the length of the pool structure. The floor portion is supported by a first row of tabs 32. The floor portion 31 is positioned such that it directs the flow of concrete so that the concrete is poured correctly, as described later.

The inner wall structure 13 has a second top flange 33A located at the further most top end 28A. The top flange 33A is located on the top end 28A of the inner wall structure 13 and extends horizontally inward. A second bottom flange 35A and 35B is located at the furthermost bottom end 28 and 29 of the wall structures. The second bottom flange 35A is located at the bottom end 28 of the inner wall structure 13 and extends horizontally inward. The second bottom flange 35B is located on the bottom end 29 of the outer wall structure 14 and extends horizontally inward.

Located on the second top flange 33A is coping 37A. The coping 37A is mounted on the top edge 39A if the flange 33A. The coping is fixed to the flange by an L-shaped member 41A. The first L-shaped member 41A is located on the top edge 39A of the flange 33A and is positioned so that the back side 43A is facing inward.

The coping 37A on the flange 33A consists of a first recess 45A in which the back side 43A is inserted and tightened with a bolt 47A. The coping 37A has a second recess 49 which is positioned and appropriately sized so that the liner for the pool can be inserted and held. The coping has a top ledge 51A.

Figure 2:
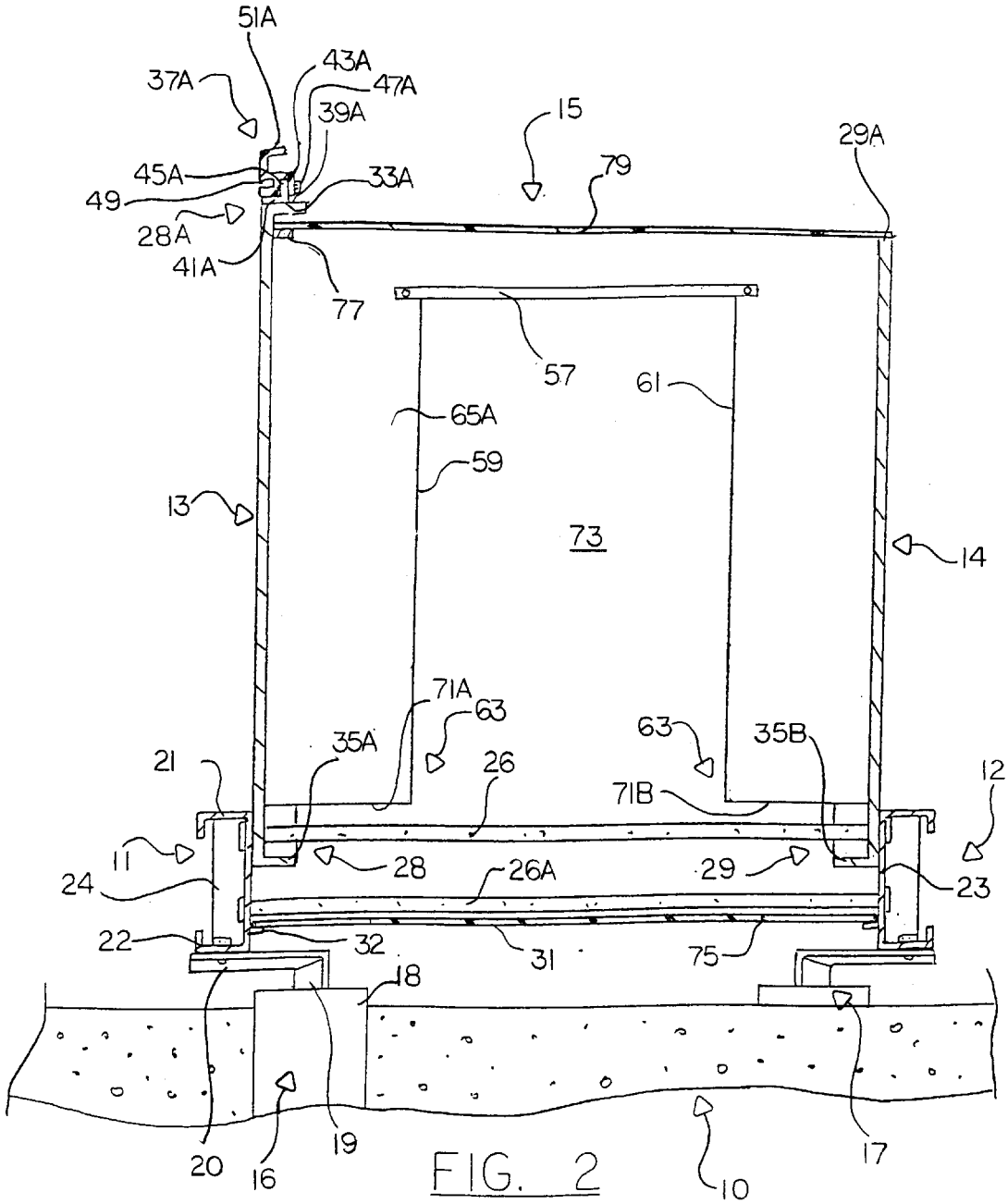
FIG. 2 is a cross sectional view similar to that of FIG. 1 but taken at a location spaced around the periphery of the pool.
Figure 3:
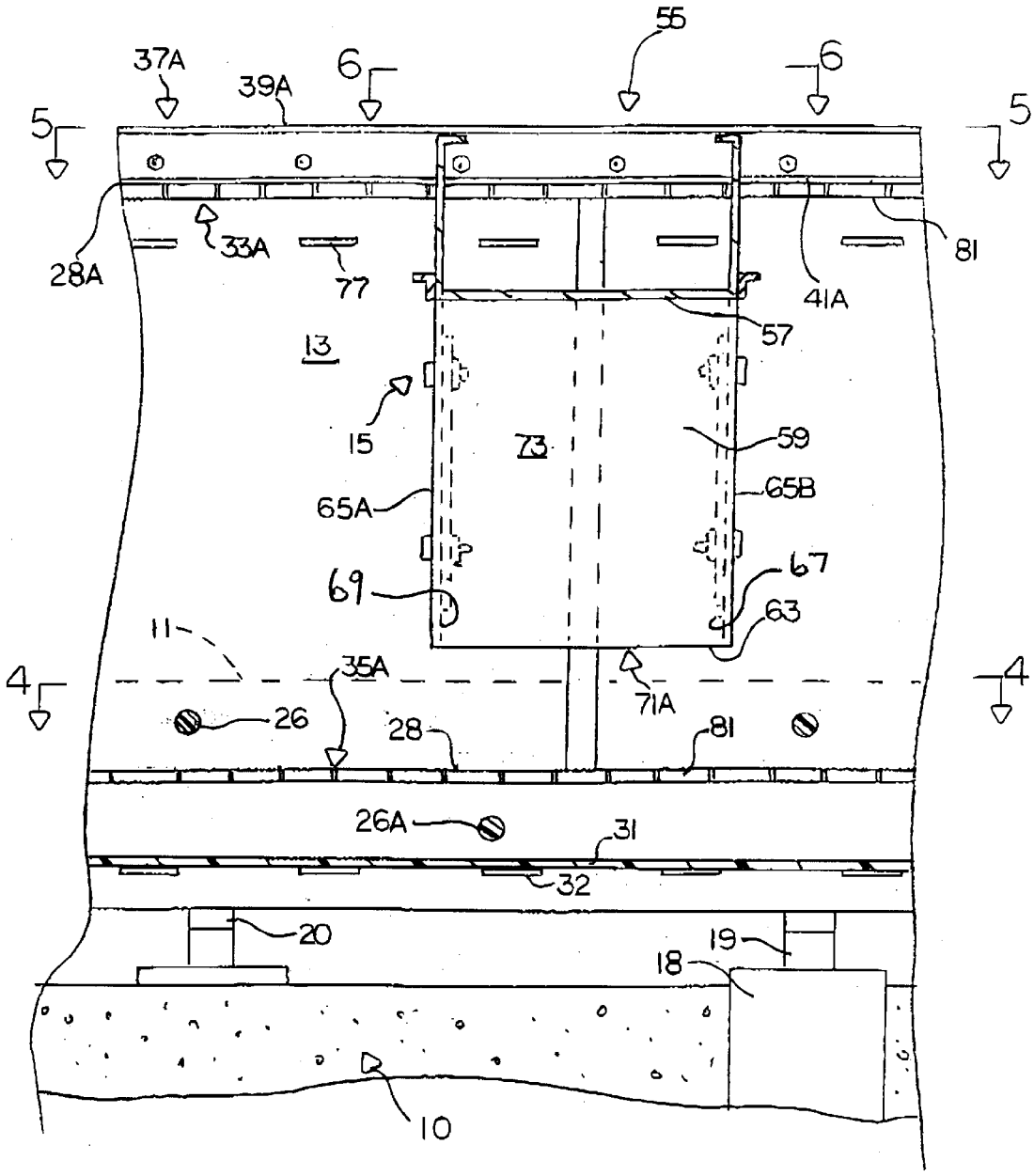
FIG. 3 is a cross-sectional view along the lines 3—3 of FIG. 2.
Figure 4:
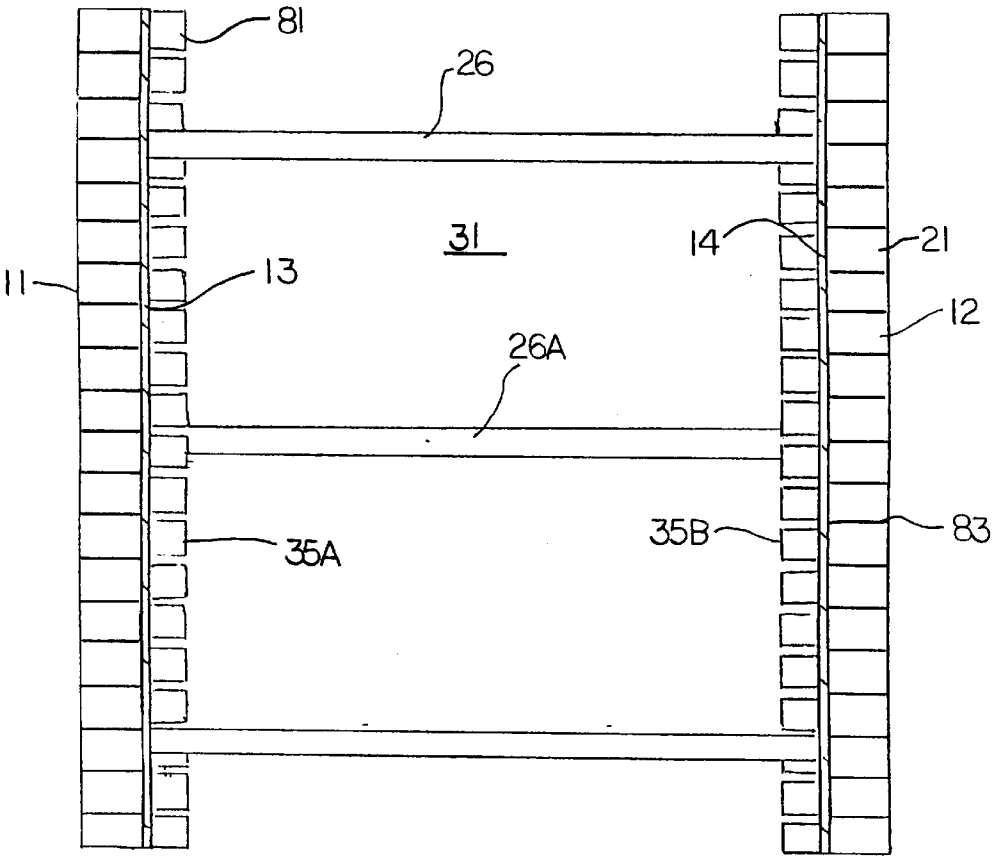
FIG. 4 is a cross sectional view taken along the lines 4—4 of FIG. 3.
Figure 5:
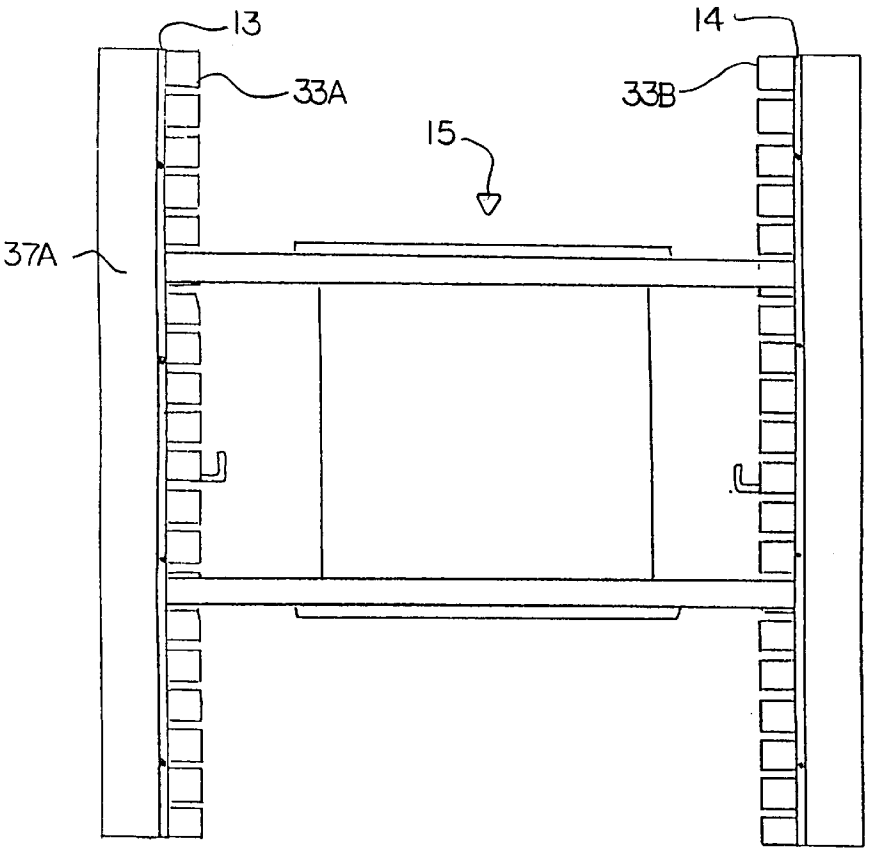
FIG. 5 is a cross sectional view taken along the lines 5—5 of FIG. 3.
Figure 6:
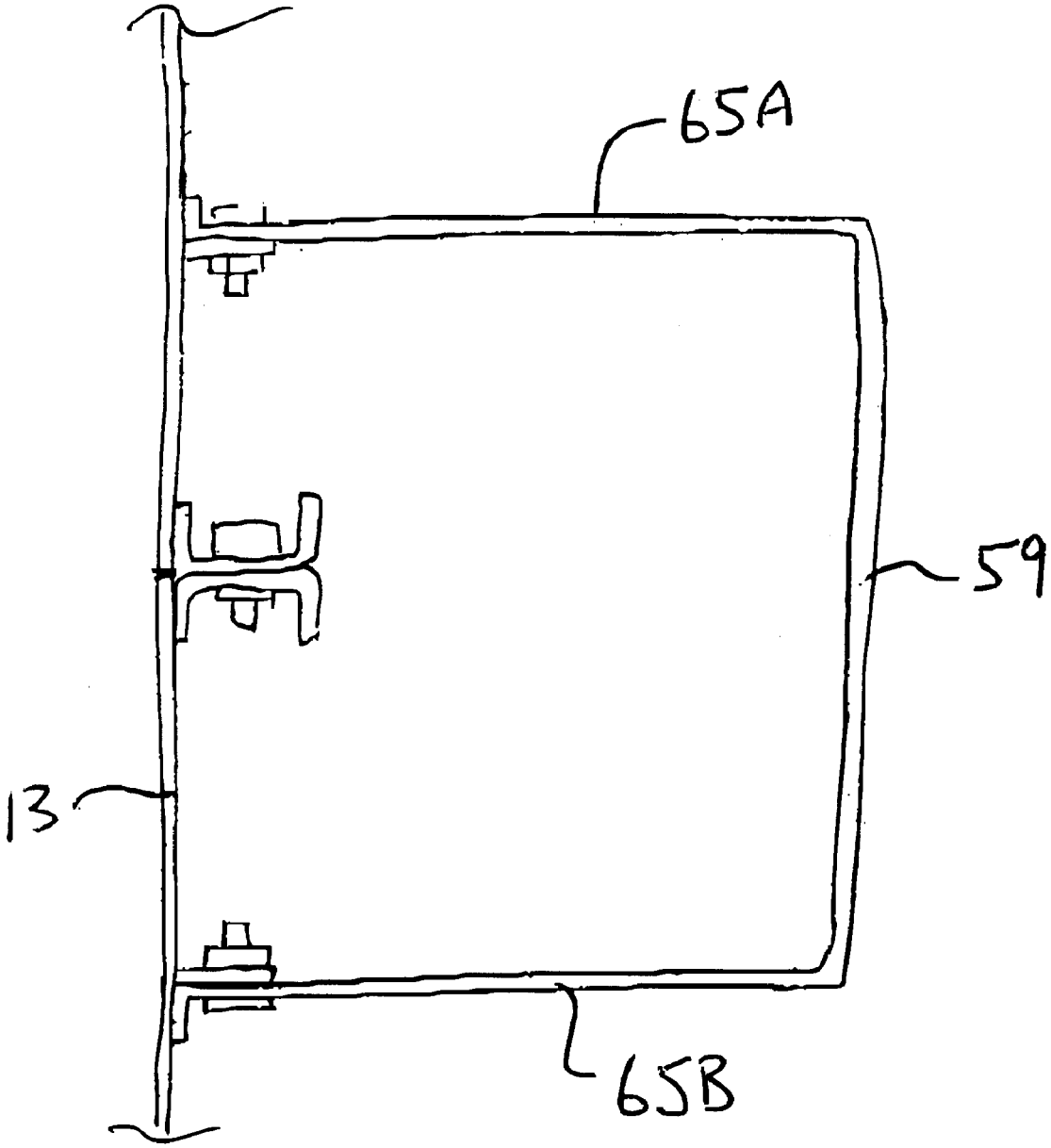
FIG. 6 is a cross sectional view taken along the lines 6—6 of FIG. 3.

Located slightly below the flange 33A is a plurality of second tabs 77 which extends horizontally inward from the inner wall structure 13. The tabs 77 are positioned such that the top floor portion 79 can be mounted. The top floor portion 79 extends horizontally inward and to the outer wall structure 14 and rests on the top end 29A of the outer wall 14. The outer wall structure 14 is of a shorter length than the inner wall structure such that the second tabs 77 are higher than the outer wall 14 to allow the top floor portion 79 to be positioned at a slight angle downward and in a direction away from the inner wall 13 to allow water and the like to flow away from the pool water. As best shown in FIG. 2.

When the concrete generally indicated at 53 is applied to the structure it is poured into the top opening 55 of the arch member 15. The concrete 53 is directed downwardly until it reaches the top shelf 57 which extends horizontally across the arch member 15. A first wall 59 extends vertically downwardly from one end of the top shelf 57 to the bottom end 63 of the arch member 15 and is parallel to the inner wall structure 13. The second wall 61 extends vertically downwardly from one end of the top shelf to the bottom end 63 of the arch member 15 and is parallel to the outer wall structure 14. The walls 59 and 61 are parallel to each other and are of equal size.

Outside arch walls 65A and 65B surround the arch member 15. The outside wall 65A is located on the front side 67 of the arch member 15. The outside wall 65B is located on the back side 69 of the arch member 15. The outside wall 65A and 65B are parallel and are of equal size.

The arch member has a top opening 55 and two bottom openings 71A and 71B. The bottom opening 71A and 71B are on opposing sides of the structure being located at the furthermost bottom end of the arch member 15. The bottom openings allow the concrete to flow through to the floor portion filling the structure with concrete. The concrete is directed to flow into the arch member 15 and to be level with the bottom of the arch member leaving the center open portion 73 to act as a crawl space for hoses and the like to be ran through the pool structure.

The floor portion 31 has a plurality of holes 75 which is shaped accordingly to allow the concrete to flow correctly into the assigned position designed to support the structure. When the concrete is set the side rails 11 and 12 are removed and the horizontal support 20 on the inner row anchor 16 and outer row anchor 17 is cut so that the horizontal support 20 is flush with the extended anchor 16B.

The arch member 15 is removed when the concrete is set.

Figure 7:
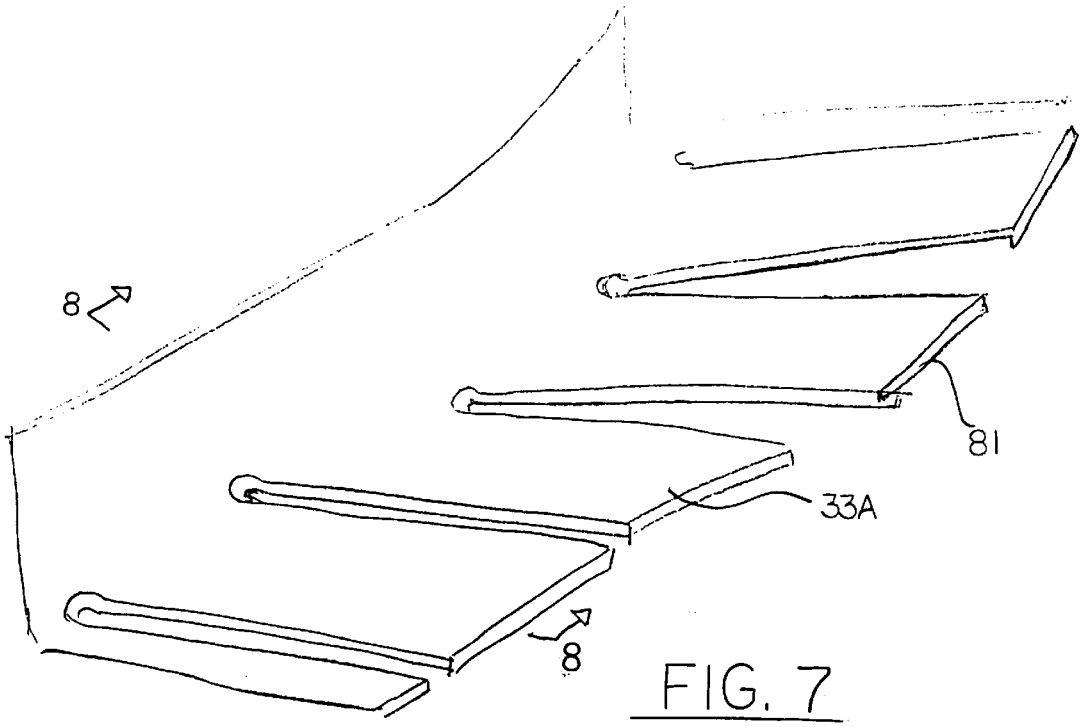
FIG. 7 is an isometric view of the flange member on the top or bottom edge of the wall panels showing the bending effect.
Figure 8:
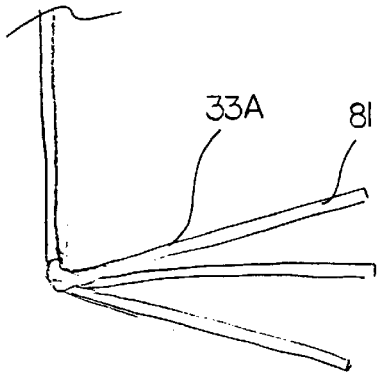
FIG. 8 is a cross sectional view along the lines 8—8 of FIG. 7.

In order to enable the pool structure to be built to the desired shape the inner wall structure 13 and the outer wall structure 14 must be able to bend and form to the desired shape. The flange 33A and the bottom flanges 35A and 35B consist of slotted portions 81. The slots 81 allow the walls 13 and 14 to be formed and bent. To bend and form the walls 13 and 14 the flange slots 81 can be manipulated such that the slots separate, as best shown in FIGS. 7 and 8. In FIG. 7 the slots are separated so that the inner or outer wall structure can bend putting the flange on the convex side. In FIG. 8 the individual slots are bent upward and downward such that the inner and outer wall can bend putting the flange on the concave side.

A similar arrangement to the slots 81 is found on the rails 11 and 12. The rails 11 and 12 have a second arrangement of slots 83 found on the top horizontal flange 21 and on the bottom horizontal flange 22. The slots 83 allow the rails to be manipulated to form the desired shape or form. The slots 83 separate when the rail is formed such that the slots 83 are found on the convex side. The individual slots 83 are bend upward and downward such that the rails can be forms putting the slots 83 on the concave side.

When the slots are on the same side the first arrangement of slots 81 are separated and on the convex side the second arrangement of slots 83 are positioned in the up and down position and on the concave side. When the first arrangement of slots 81 are in the up and down position and on the concave side the second arrangement of slots 83 are separated and on the convex side.

Figure 9:
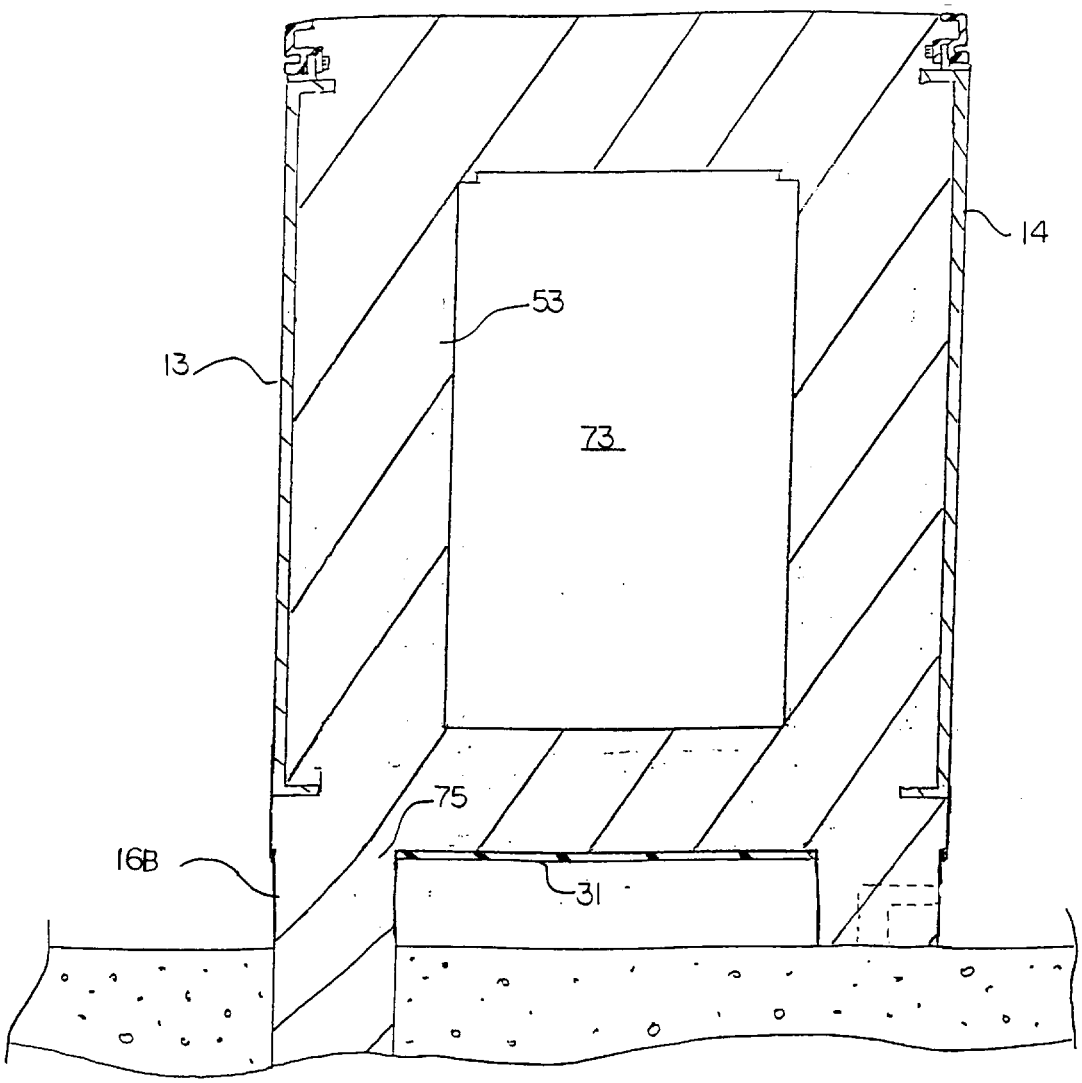
FIG. 9 is the same cross sectional view as FIG. 1 with the concrete cast in place and the rails and arch members removed.
Figure 10:
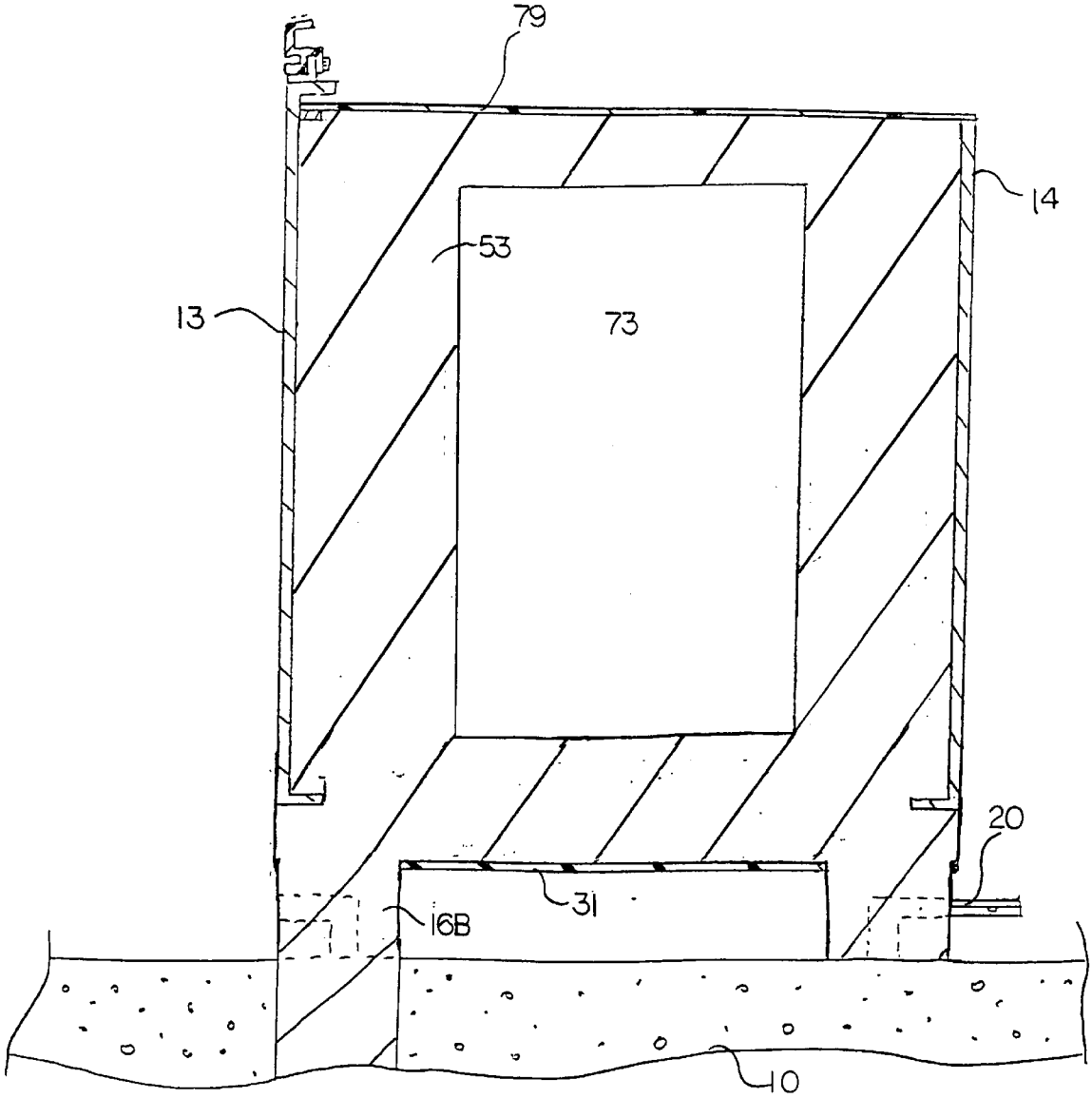
FIG. 10 is the same cross sectional view as FIG. 2 with the concrete cast in place and the rails and arch members removed.

The embodiment in FIG. 1 and FIG. 9 show the pool structures construction which is formed to be an island or the like for the pool. The outer wall structure 14 is the same as the inner wall structure and the concrete reaches an equal height as the coping.

Figure 11:
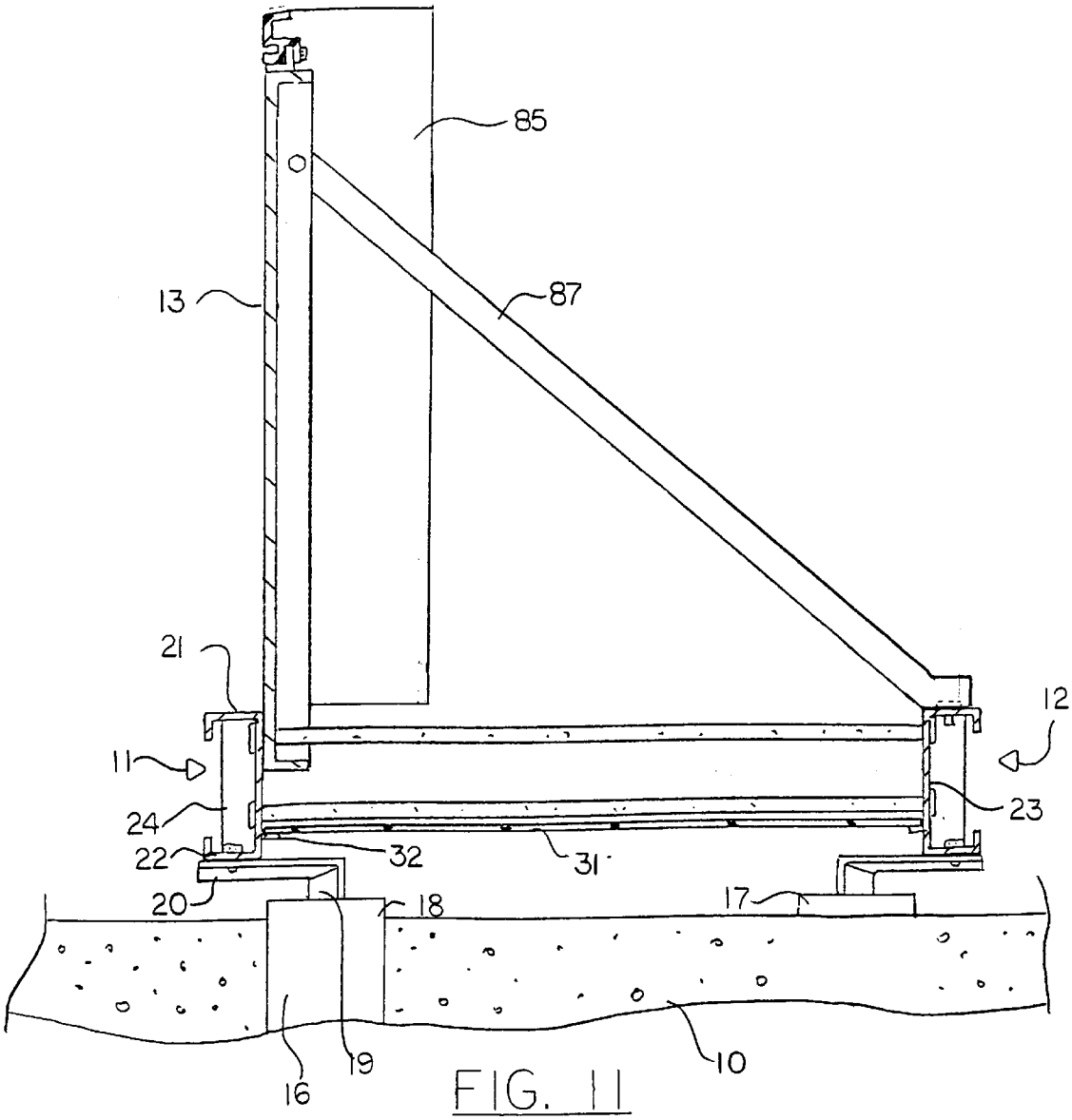
FIG. 11 is a cross sectional view similar to that of FIG. 1 showing a simplified construction for use with smaller pools where the double wall construction is not required.
Figure 12:
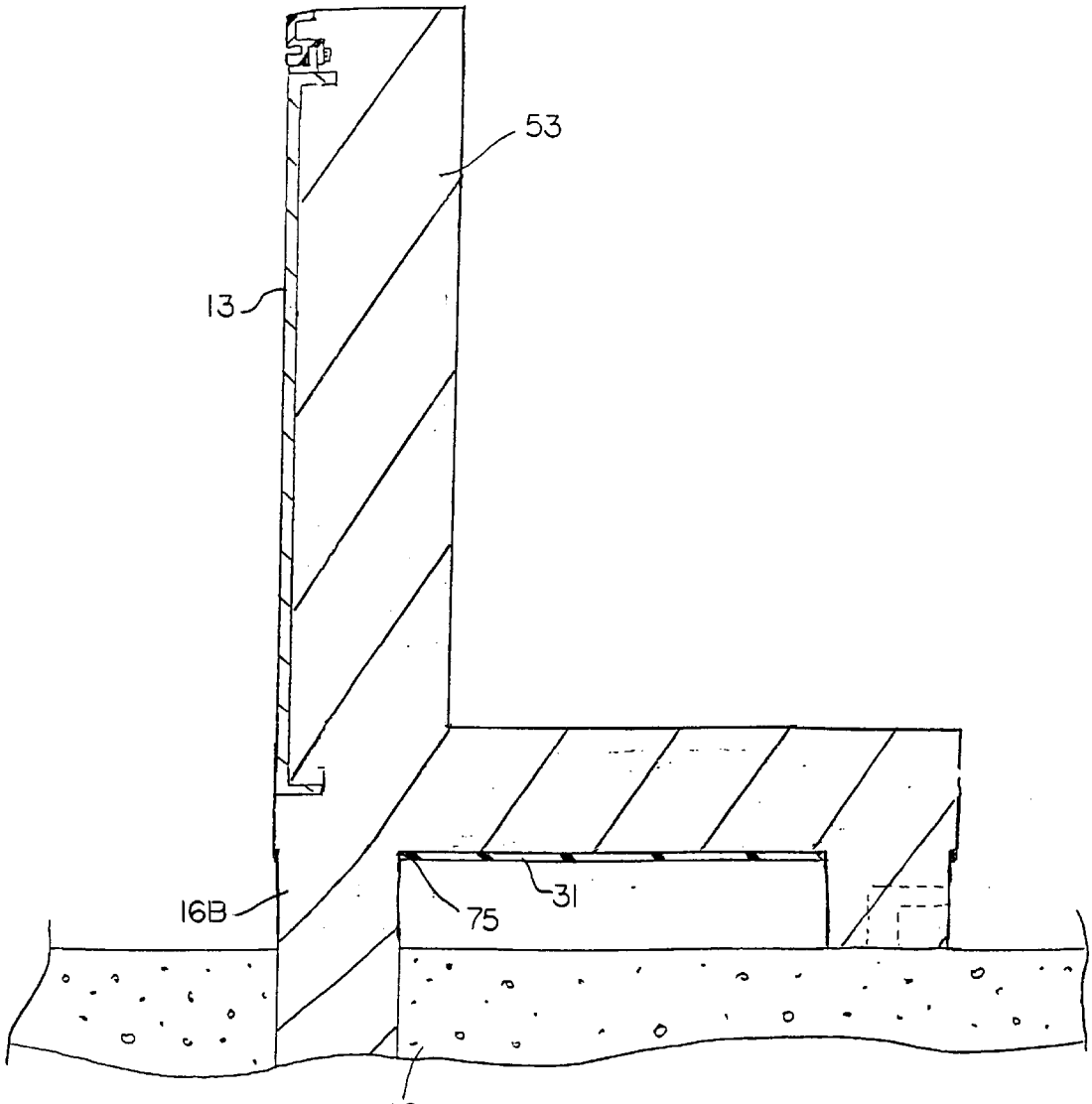
FIG. 12 is a cross sectional view similar to that of FIG. 11 with the concrete added and the supports removed.

The embodiment in FIG. 11 and FIG. 12 shows the pool structure which the outer wall structure 14 is removed. The outer wall is not necessary is construction of smaller pools. The arch member 15 is removed and replace with a single sided construction 85. A support arm 87 holds the structure stable while in the first stages and is removed when the concrete is added, as best shown in FIG. 12.

Turning now to the embodiment shown in FIGS. 13 through 18, this shows a yet further improved arrangement modified relative to the above described embodiment to provide a series of important advantages which allow a significant reduction in labour costs and material costs in manufacturing the construction.

Various stages of the construction as shown in FIGS. 13 through 17 and the completed assembly prior to removal of the forming elements is shown in FIG. 18.

Figure 13:
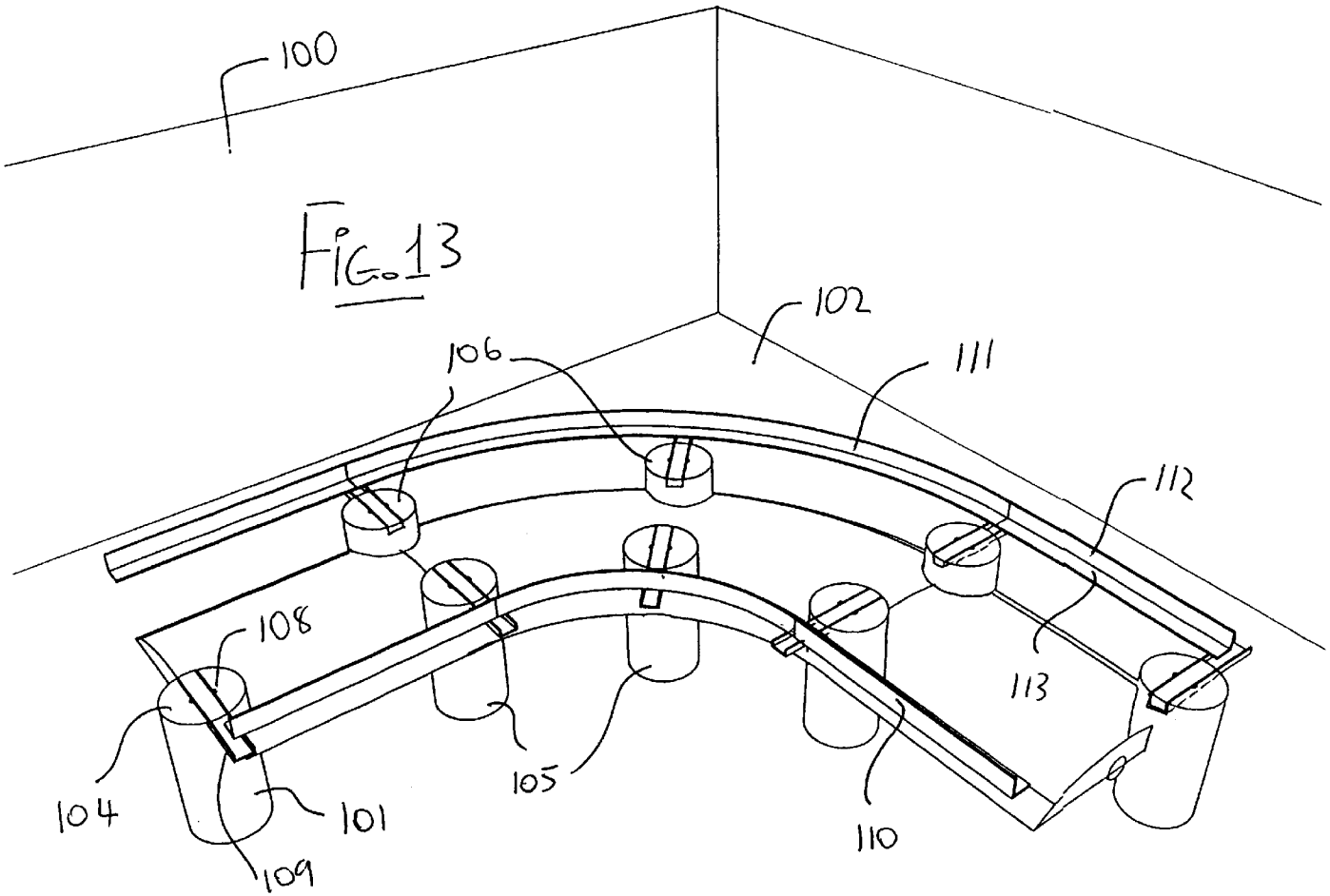
FIGS. 13 to 17 each show an isometric view of a respective one of the various stages of a second embodiment of the construction method according to the present invention.

Turning firstly to FIG. 13, an initial stage of the construction involves the excavation of the ground to provide the recessed area 100 within which the pool is to be constructed. Within this area is formed a plurality of concrete piles 101 which are engaged into the ground below the new excavated level 102 and project upwardly from level 102 to provide a cylindrical pile body with a top surface 104. The piles are arranged to form an inner row 105 and an outer row 106. In the area shown in FIG. 13 where the is a curved section of the pool, the piles are arranged so that each is paired with another in the outer row. However in places where the pool wall is straight, the piles can be alternated so that there is a pile in the inner and the next pile on the outer row is in between the two piles on the inner row.

Each pile when cast includes conventional reinforcing bars 108 which project outwardly beyond the top of the pile and in addition there is provided a channel member 109 which is embedded in the top surface 104 so that the channel member has a flat web within the concrete and two upstanding side walls which stand up to the same height as the top flat surface 104 upper pile. The channels 109 of the inner row 105 project inwardly relative to the pool construction and the channels 109 of the outer row of piles project outwardly relative to the pool construction.

A plurality of inner rails 110 are located on the channel supports 109 at a position for defining the location of the inner pool wall. These inner rails are temporarily attached to the channel supports 109 and arranged end to end to form a complete rail track extending around the periphery of the pool. The temporary attachment can be carried out by tack welding or by other suitable coupling devices.

Similarly corresponding outer rails 111 are located on the outer channel support members and follow the path of the pool periphery at a constant spacing around the pool periphery so as to define a constant spacing between the intended position of the inner wall and the intended position of the outer walls.

Each of the rails is formed by a right angle member defining a simple vertical flange 112 and a simple horizontal flange 113 so that the rails are of simple inexpensive construction. The horizontal flange sits directly on top of the channel support member and the vertical flange stands upwardly therefrom. The vertical flange is arranged facing inward for the inner rails and facing outward for the outer rails so as to define an area therebetween defined by the two upstanding vertical flanges.

Figure 14:
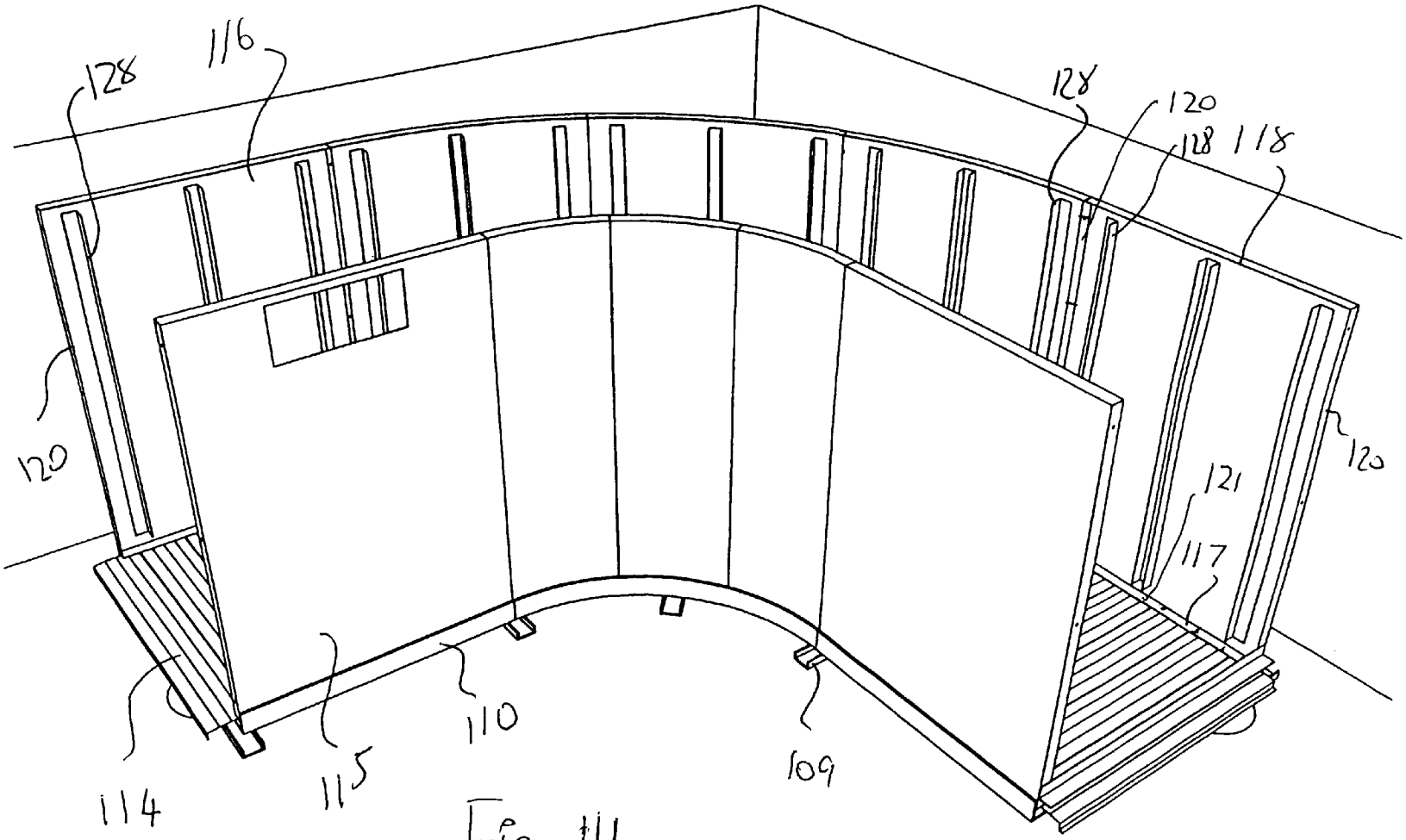
Figure 15:
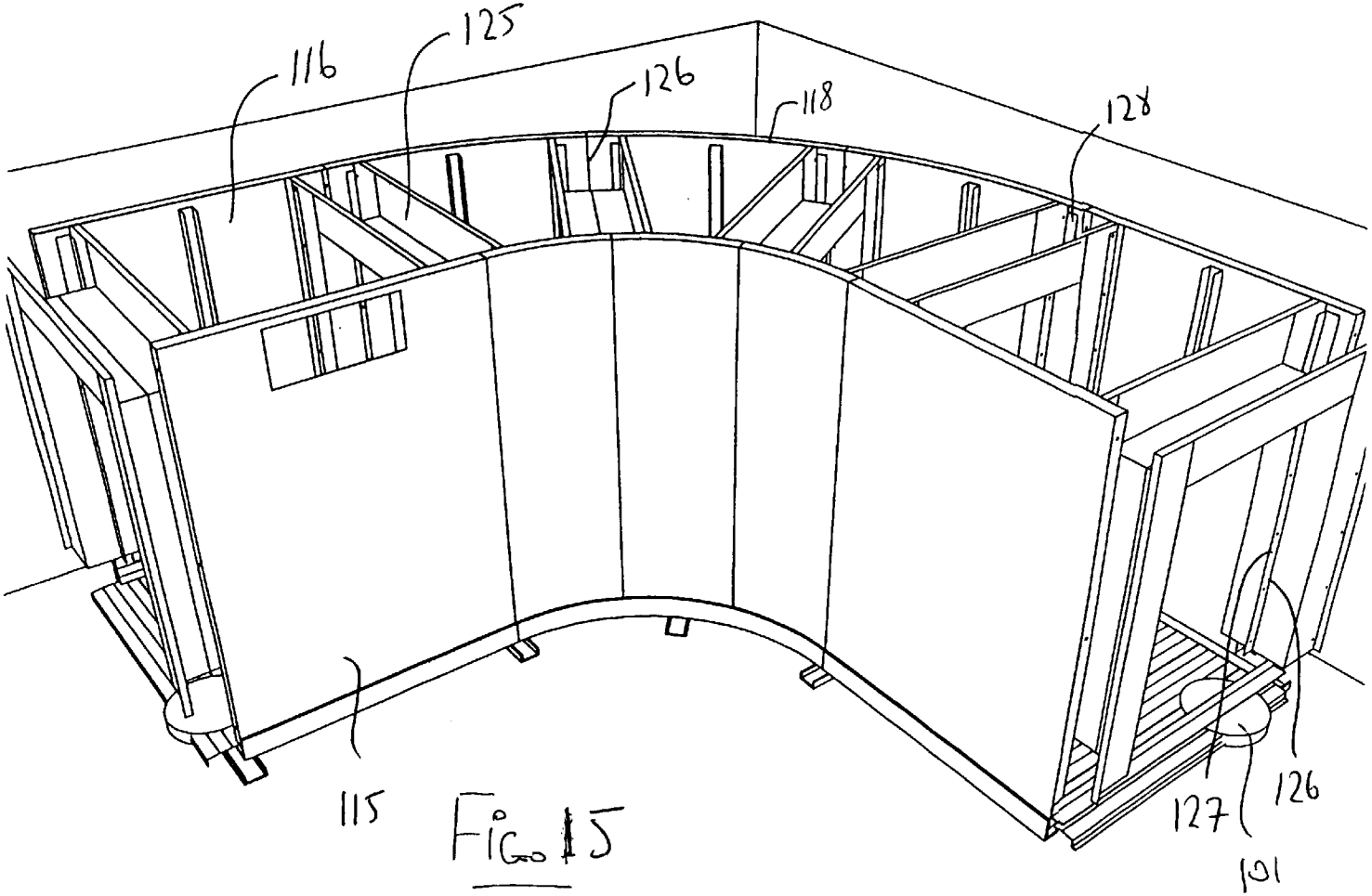
Figure 16:
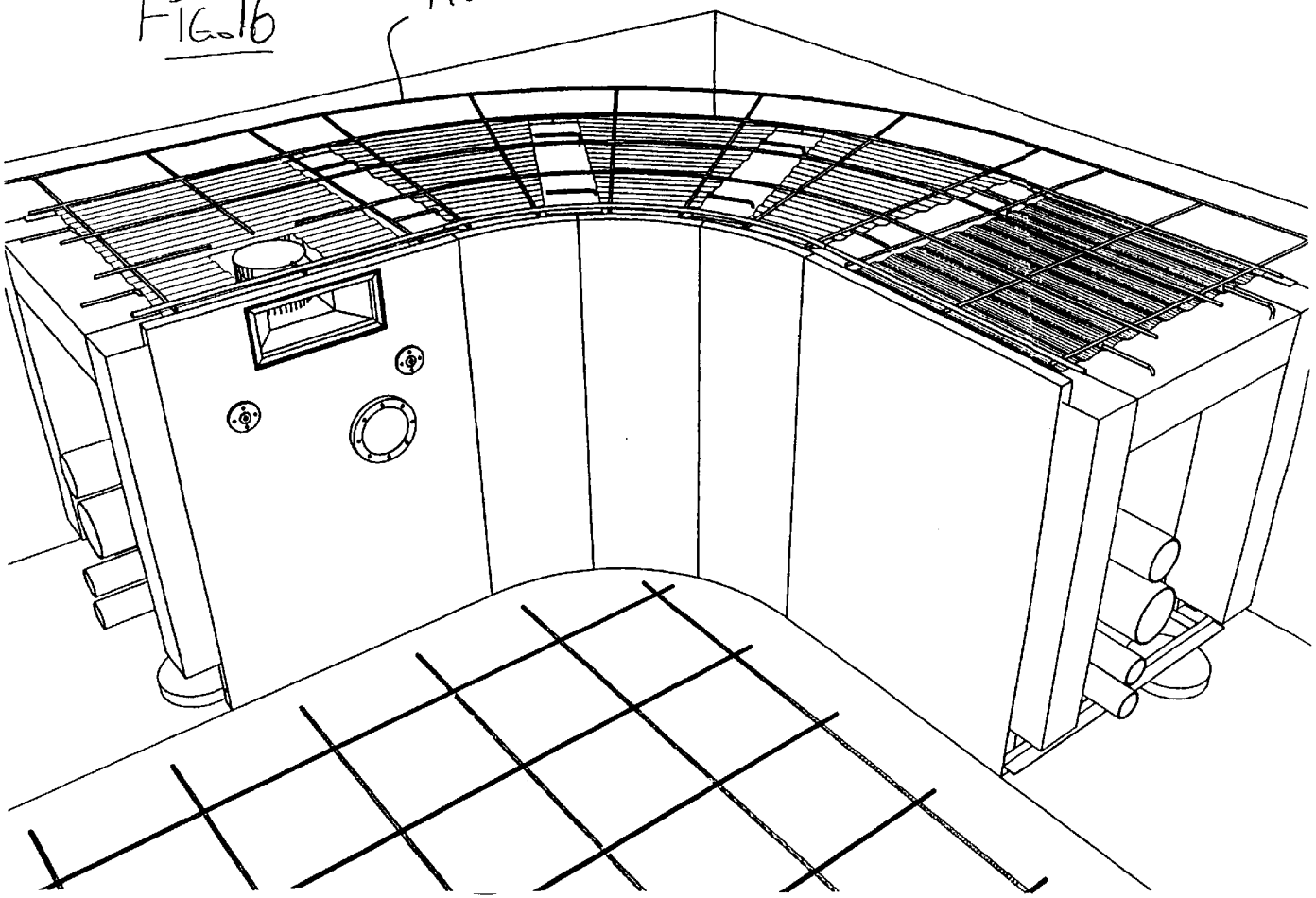
Figure 17:
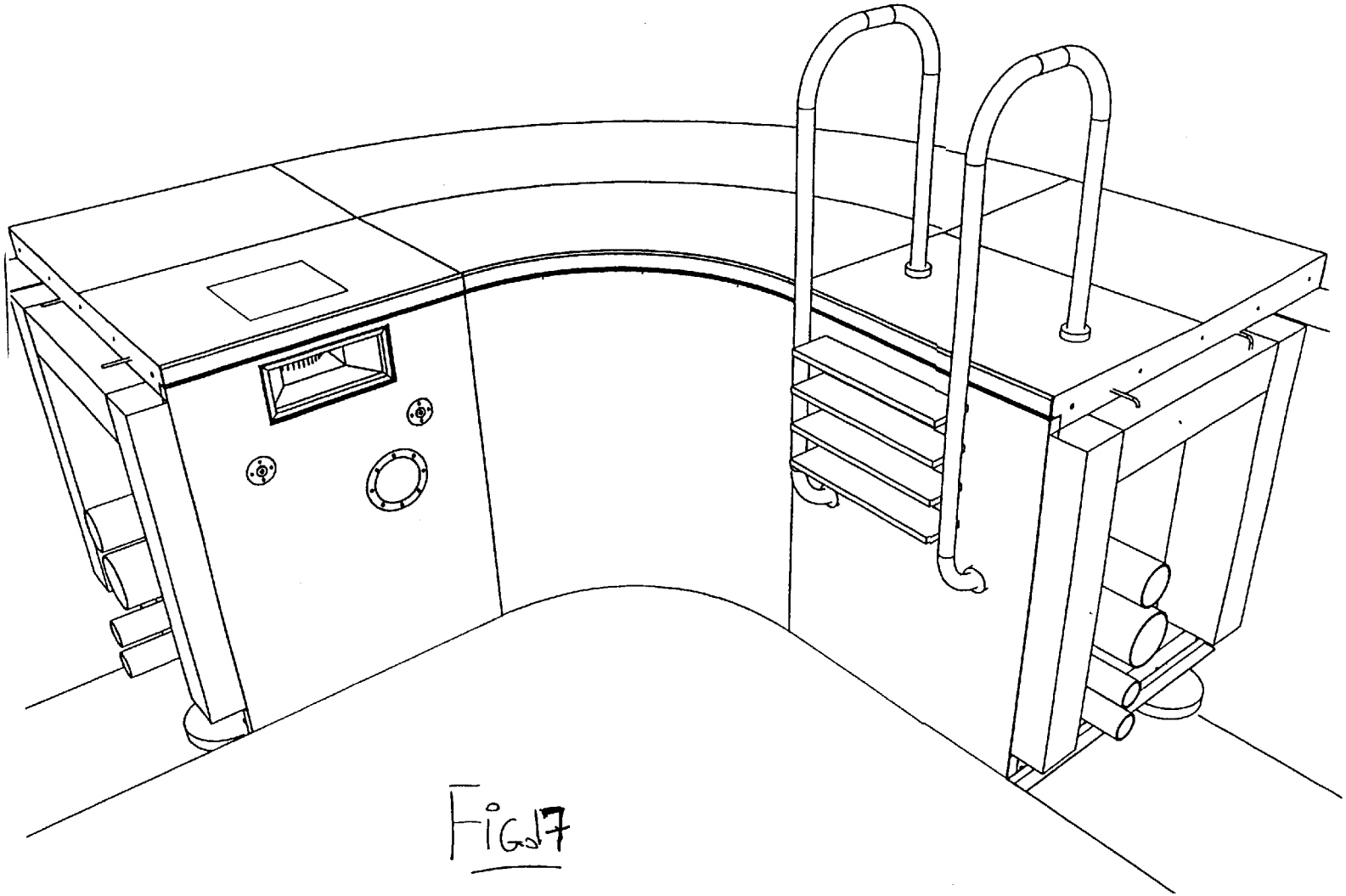
Figure 19:
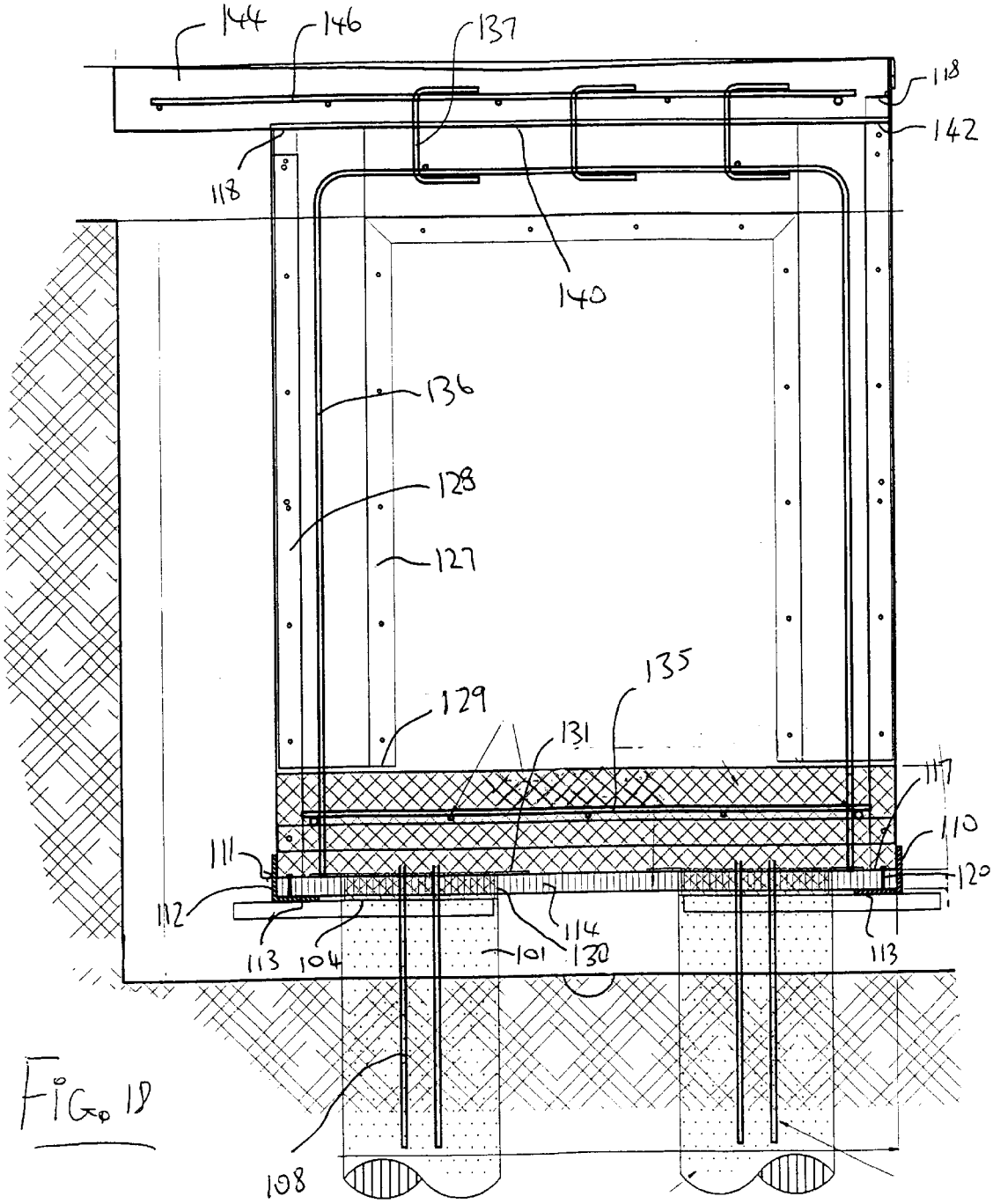

In the next phase shown in FIG. 14 a series of floor panels 114 are applied over the piles with each floor panel spanning the distance between the vertical flanges 112 so that edges of the floor panels sit on the horizontal flanges 113.

With the floor panels in place, the inner and outer wall panels 115 and 116 respectively are applied onto the edges of the floor panels at the horizontal flanges 113 of the inner and outer rails respectively. Each wall panel has a bottom flange 117 and a top flange 118 turned at right angles to the surface of the wall panel. Similarly each wall panel has side flanges 120 also turned inwardly at right angles. The top and bottom flanges as previously described are notched so as to allow the panels to be bent to follow the shape of the rails without the necessity for pre-forming the wall panels into the required shape. Thus the wall panels can be supplied in flat form and matched on site to the required curvature to follow the rail to which it is to be attached.

The flanges 117 sit on top of the floor and a series of fasteners are applied through the bottom flange 117 into the floor so as to fasten the bottom flange and therefore the wall panel to the floor so as to stand upwardly therefrom. The outside surface of the wall panel butts against the vertical flange 112.

As previously described, the walls panels after bending to the required shape are arranged edge to edge so that the side flanges 120 are engaged each with the next panel and the side flanges are connected by suitable screw fasteners to hold the structure temporarily upright. In order to maintain the wall panels vertical, a plurality of arch form members 125 at spaced positions along the length of the pool periphery. Each arch form member is formed in two separate pieces defining a left half and a right half respectively joined along a seam line 126. Each half forms a rigid structure defining one half of the vertical leg at the inner wall and one half of the vertical leg at the outer wall together with one half of the truss piece. Thus each half comprises a web section for each of the legs on the cross piece together with a vertical flange for each of the legs in the cross piece. At the seam 126 is provided a flange 127 which projects from the channel member at right angles so that the two flanges 127 side by side can be bolted together to form the channel form member into the complete rigid structure. The wall panels include attached angle members 128 adjacent the edge flanges 120 and these provide a flange at right angles to the wall panel so that the edges of the vertical flanges of the channel form members can be fastened temporarily to the angle members 128 by a plurality of fasteners along the height of the arch form member. The bottom edge of the arch form member 129 is spaced upwardly from the floor panel 114 by a distance equal to and intended thickness of the floor pad.

In view of the fact that the arch form members are rigid in structure defined by the two halves each of which forms integrally to legs and the cross piece ensures that the arch form member when bolted together and when bolted to the side walls is rigid and holds side walls rigid and parallel.

With the side walls now held secure, holes are cut in the floor panels at locations immediately on top of the piles 101 so that the top 104 of the pile is exposed through the floor. This also leaves reinforcing bars 108 exposed at the top and exposed into or through the floor.

Through the floor is applied a tubular forming member 130 which includes a top portion 131 sitting on top of the floor and a cylindrical portion extending downwardly around the pile so as to provide a connection between the pile and the top of the floor. With the arch form members in place, reinforcing bars 135 are laid on top of the floor 114 at a height spaced from the floor so as to provide reinforcing bars in the center area of the intended layer of concrete. Further reinforcing bars 136 are applied through the arch members in a loop surrounding the arch members so as to provide the bottom part of the reinforcing bars within the floor and an arch portion of the reinforcing bar through the arch member. Further reinforcing bars 137 are applied in the cross piece of the arch member and stand upwardly from the top of the arch member in a C shaped loop to form a section in a top cap to be subsequently cast.

With the reinforcing bars in place, it is poured into the floor section between the arch members and is poured down each leg of each arch member and onto the cross piece of each arch member to form an integral concrete structure defined by the floor and the plurality of arches.

With the concrete cast and set, the arch form members can be removed by disconnecting the fastenings from the angles 120 on the side walls and disconnecting the flanges 127 thus releasing the two halves which can be broken away from the concrete and pulled out from the interior for reuse.

In addition the angle members 110 and 111 defining the rails can simply be pulled out after breaking the temporary attachment to the channel support members 109. Again therefore the rails are readily available for re use.

The casting of the floor onto the piles ensures that the floor is integrally connected with the piles so that the whole structure including the floor and the arches form the rigid structure holding the inner and outer wall panels rigid.

A top cover is formed by applying a plurality of cover panels 140 onto the top of the arches after they are cast. The panels 140 extend from the top flange 118 at the top of the rear panel to an intermediate support flange 142 on the front panel spaced downwardly from the top flange 118 of that panel. The cover sheets 140 thus bridge the areas between the arches and allow a concrete pad 144 to be cast on top of the arches and on top of the cover panels. The cast concrete pad includes reinforcing bars 146 of a conventional nature and engages into the upper part of the bars 137 which thus integrate the arches with the cast concrete cap.

The remaining structure thus after removal of the forming elements defined by the arch members and the rails is of a simplified structure with much of the structure being reusable. In fact the floor panels and the cover panels can also be removed in many cases simply by pulling them from underneath the concrete when cast.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. A method of forming a swimming pool construction having a peripheral pool wall comprising:

providing a plurality of ground anchor members arranged at longitudinally spaced positions and at a common levelled height;

the ground anchor members including an inner row and an outer row spaced at a common distance outwardly relative to the pool shape from the inner row;

providing on each of the inner row of the ground anchor members an inwardly extending inner support member;

providing on each of the outer row of the ground anchor members an outwardly extending outer support member;

providing a plurality of inner rail members and a plurality of outer rail members each having a bottom support surface and a vertical abutment surface;

arranging the inner rail members end to end and mounting the inner rail members with the bottom support surface thereof supported on the inner support members to follow the pool shape, the vertical abutment surface of the inner rail members oriented to define a retaining surface;

arranging the outer rail members end to end and mounting the outer rail members with the bottom support surface thereof supported on the outer support members to follow the pool shape, the vertical abutment surface of the outer rail members oriented to define a retaining surface;

providing a plurality of inner pool wall panels;

locating a bottom edge of the inner pool wall panels on the inner rail members at an outwardly facing retaining surface of the inner rail members so as to stand upwardly therefrom and connecting the inner wall panels end to end to form an inner pool wall;

supporting the inner pool wall panels so as to stand vertically upwardly from the inner rail members;

providing a plurality of outer pool wall panels;

locating a bottom edge of the outer pool wall panels on the outer rail members at an inwardly facing retaining surface of the outer rail members so as to stand upwardly therefrom and connecting the outer wall panels end to end to form an outer pool wall;

supporting the outer pool wall panels so as to stand vertically upwardly from the outer rail members;

the inner and outer wall panels being supported by:

forming a plurality of arch members each having a first leg at a respective one of the inner wall panels, a second lea at a respective one of the outer wall panels and a cross piece;

the legs of the arch member comprising a channel shaped structure having a pair of side walls spaced along the panel and a web wall spanning the side walls and spaced from the respective panel;

the cross piece of the arch member comprising a channel shaped structure having a pair of side walls spaced along the inner and outer panels and a web wall span fling the side walls ands aced downwardly from a top edge of the side walls;

casting a concrete arch into the arch member such that one leg of the concrete arch is connected to the inner panel and the other leg of the concrete arch is connected to the outer panel;

and removing the arch members such that the inner and outer wall panels are supported by the cast concrete arches;

casting a concrete base layer between the retaining surface of the inner rail members and the retaining surface of the outer rail members such that the concrete base layer engages the bottom edge of the inner and outer wall panels;

and removing the inner and outer rail members leaving the inner and outer wall panels supported in place on the concrete base layer.

2. The method according to claim 1 wherein each of the inner and outer rail members comprises an angle member defining a vertical flange forming the vertical abutment surface and a horizontal flange forming the bottom support surface and wherein the flange is located underneath the bottom edge of the inner pool wall panels so as to provide support therefor.

3. The method according to claim 1 wherein the bottom edge of the inner wall panels includes an outwardly turned edge flange member.

4. The method according to claim 1 wherein the ground anchor members are formed of cast concrete having a flat supporting top surface; wherein the inner and outer support member have an upper support surface of the support member flush with the respective flat top surface; wherein there is provided a plurality of floor panels which are located so as to span between the vertical abutment surfaces of the inner and outer rail members and so as to rest upon the inner and outer rail members and closely adjacent the flat top surfaces of the cast concrete ground anchor members; wherein holes are cut in the floor panels at the flat top surfaces of the ground anchor members and wherein the concrete base layer is cast on the floor panels between an outwardly facing retaining surface of the inner rail members and an inwardly facing retaining surface of the Outer rail members and through the holes such that the concrete base layer rests upon and receives support from the flat top of the cast concrete ground anchor members.

5. The method according to claim 1 including forming the arch member in two parts each defined by one side wall of the cross piece and one side wall of each of the legs and one portion of the web wall of the cross piece and each of the legs such that the two parts are connected together along a seam across the web walls of the legs and the cross piece, the arch member so formed being rigid so that the legs are retained at right angles to the crosspiece to hold the inner and outer panels parallel.

6. The method according to claim 1 including casting the concrete arches and the base layer substantially simultaneously such that setting occurs simultaneously to form an integral structure.

7. The method according to claim 1 including providing the arch members at the bottom of the legs thereof with an open mouth and forming the base layer to a level substantially equal to the bottom of the legs so as to be integral with the cast concrete arch and allowing the arch member to be removed from the concrete arch and from the base layer.

8. The method according to claim 1 including forming for each leg of each arch member on the respective one of the inner and outer wall panels a pair of parallel vertical flanges and bolting the sides of the leg to the flanges for casting of the concrete arch and for subsequent removal of the arch member.

9. The method according to claim 1 including providing a plurality of top supporting panels and supporting each support panel on the concrete arches across the inner and outer wall panels and between the concrete arches and casting a concrete cover layer over the support panels.

10. The method according to claim 1 including supplying the rail members in a pre-curved shape and supplying the panels in a flat shape for curving to match the rail members.

11. The method according to claim 2 wherein a substantially horizontal floor panel extends across and rests upon the horizontal flange members.

12. The method according to claim 2 wherein the inner and outer support members are each defined by a U-shaped channel member with legs thereof facing upwardly so that the horizontal flanges rest thereon.

13. The method according to claim 2 wherein a horizontal flange of the rail member rests upon the inner support member and is temporarily attached thereto.

14. The method according to claim 13 wherein the inner pool wall panels have a bottom flange resting upon an edge of the horizontal floor panel at the vertical abutment surface.

15. A method of forming a swimming pool construction having a peripheral pool wall comprising:

providing a plurality of cast concrete ground anchor members arranged at longitudinally spaced positions and at a common levelled height;

the cast concrete ground anchor members including an inner row and an outer row spaced at a common distance outwardly relative to the pool shape from the inner row;

the cast concrete ground anchor members having a supporting top surface;

providing on each of the inner row of the ground anchor members an inwardly extending inner support member having an upper support surface of the support member flush with the top surface;

providing on each of the outer row of the ground anchor members an outwardly extending outer support member having an upper support surface of the support member flush with the top surface;

providing a plurality of inner rail members and a plurality of outer rail members;

arranging the inner rail members end to end and mounting the inner rail members supported on the inner support members to follow the pool shape;

arranging the outer rail members end to end and mounting the outer rail members supported on the outer support members to follow the pool shape;

providing a plurality of floor panels and locating the floor panels so as to span between the inner and outer rail members and so as to rest upon the inner and outer rail members;

providing a plurality of inner pool wall panels;

locating a bottom edge flange of the inner pool wall panels on an outer edge of the floor panels at the inner rail members so as to stand upwardly therefrom and connecting the inner wall panels end to end to form an inner pool wall;

supporting the inner pool wall panels so as to stand vertically upwardly from the inner rail members;

cutting holes in the floor panels at the ground anchor members;

casting a concrete base layer on the floor panels between the inner rail members and the outer rail members and through the holes such that the concrete base layer rests upon and receives support from the top of the cast concrete ground anchor members;

and removing the inner and outer rail members leaving the inner and outer wall panels supported in place on the concrete base layer.

16. The method according to claim 15 wherein the inner and outer support members are each defined by a U-shaped channel member with legs thereof facing upwardly.

17. A method of forming a swimming pool construction having a peripheral pool wall comprising:

providing a plurality of inner pool wall panels;

locating and supporting the inner pool wall panels so as to stand generally vertically upwardly;

and supporting the inner wall panels by:

forming a plurality of separate arch members at spaced positions around the pool;

each separate arch member having a first leg at a respective one of the inner wall panels, a second leg spaced outwardly from the inner wall panels and a cross piece;

the legs of the arch member comprising a channel shaped structure having a pair of side walls spaced along the respective panel and a web wall spanning the side walls and spaced from the respective panel;

the cross piece of the arch member comprising a channel shaped structure having a pair of side walls spaced along the inner and outer panels and a web wall spanning the side walls and spaced downwardly from a top edge of the side walls;

temporarily attaching edges of the first leg to the inner panels;

and casting a respective separate concrete arch having a first leg, a second leg and a crosspiece into each arch member such that the first leg of the respective concrete arch is connected to the inner panel;

such that the first leg of each separate concrete arch is separate from the first leg of each next adjacent concrete arch;

such that the second lea of each separate concrete arch is separate from the second leg of each next adjacent concrete arch;

and such that the cross-piece of each separate concrete arch is separate from the cross-piece of each next adjacent concrete arch;

casting a concrete floor connected with the concrete arches;

and removing the arch members such that the inner wall panels are supported by the cast concrete arches and the concrete floor.

18. The method according to claim 17 including forming each arch member in two parts each defined by one side wall of the cross piece and one side wall of each of the legs and one portion of the web wall of the cross piece and each of the legs such that the two parts are connected together along a seam across the web walls of the legs and the cross piece; the arch member so formed being rigid so that the legs are retained at right angles to the crosspiece to hold the inner and outer wall panels parallel and at a required spacing.

19. A method of forming a swimming pool construction having a peripheral pool wall comprising:

providing a plurality of inner pool wall panels;

providing a plurality of outer pool wall panels;

locating and supporting the inner pool wall panels so as to stand generally vertically upwardly;

locating and supporting the outer pool wall panels so as to stand generally vertically upwardly and to follow the inner wall panels at a position spaced outwardly therefrom;

and supporting the inner and outer wall panels by:

forming a plurality of separate arch members at spaced positions around the pool;

each separate arch member having a first leg at a respective one of the inner wall panels, a second leg at a respective one of the outer wall panels and a cross piece;

the legs of the arch member comprising a channel shaped structure having a pair of side walls spaced along the respective panel and a web wall spanning the side walls and spaced from the respective panel;

the cross piece of the arch member comprising a channel shaped structure having a pair of side walls spaced along the inner and outer panels and a web wall spanning the side walls and spaced downwardly from a top edge of the side walls;

temporarily attaching edges of the first and second legs to the inner and outer panels respectively;

and casting a respective separate concrete arch having a first leg, a second leg and a crosspiece into each arch member such that the first leg of the concrete arch is connected to the inner panel and the second leg of the concrete arch is connected to the outer panel;

such that the first leg of each separate concrete arch is separate from the first leg of each next adjacent concrete arch;

such that the second leg of each separate concrete arch is separate from the second leg of each next adjacent concrete arch;

and such that the cross-piece of each separate concrete arch is separate from the cross-piece of each next adjacent concrete arch;

casting a concrete floor connected with the concrete arch;

and removing the arch members such that the inner and outer wall panels are supported by the cast concrete arches and the concrete floor.

20. The method according to claim 19 including forming the arch member in two parts each defined by one side wall of the cross piece and one side wall of each of the legs and one portion of the web wall of the cross piece and each of the legs such that the two parts are connected together along a seam across the web walls of the legs and the cross piece; the arch member so formed being rigid so that the legs are retained at right angles to the crosspiece to hold the inner and outer panels parallel and at a required spacing.

* * * * *